US006597119B2

(12) United States Patent
Ito

(10) Patent No.: US 6,597,119 B2
(45) Date of Patent: Jul. 22, 2003

(54) METHOD FOR DRIVING AN ELECTRO-OPTICAL DEVICE, DRIVING CIRCUIT FOR DRIVING AN ELECTRO-OPTICAL DEVICE, ELECTRO-OPTICAL DEVICE, AND ELECTRONIC APPARATUS

(75) Inventor: Akihiko Ito, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/117,099

(22) Filed: Apr. 8, 2002

(65) Prior Publication Data

US 2002/0149323 A1 Oct. 17, 2002

Related U.S. Application Data

(62) Division of application No. 09/403,498, filed as application No. PCT/JP99/00806 on Feb. 22, 1999, now Pat. No. 6,426,594.

(30) Foreign Application Priority Data

Feb. 23, 1998 (JP) ..... 10-040801

(51) Int. Cl.[7] ..... G09G 3/10

(52) U.S. Cl. ..... 315/169.1; 345/51; 345/52; 345/55; 345/204

(58) Field of Search ..... 315/169.1, 169.2, 315/169.3, 169.4; 345/55, 84, 94, 87, 50, 51, 52, 41, 42, 204

(56) References Cited

U.S. PATENT DOCUMENTS

| | | | | |
|---|---|---|---|---|
| 4,180,813 A | | 12/1979 | Yoneda | 345/100 |
| 4,202,560 A | | 5/1980 | Inbody | 280/124.126 |
| 4,801,933 A | | 1/1989 | Yamamoto et al. | 345/88 |
| 5,010,327 A | | 4/1991 | Wakita et al. | 345/89 |
| 5,157,387 A | | 10/1992 | Momose et al. | 345/94 |
| 5,262,881 A | | 11/1993 | Kuwata et al. | 345/94 |
| 5,576,729 A | | 11/1996 | Yamazaki | 345/94 |
| 5,764,225 A | | 6/1998 | Koshobu | 345/94 |
| 5,874,933 A | | 2/1999 | Hirai et al. | 345/211 |
| 6,049,319 A | | 4/2000 | Sakamoto et al. | 345/89 |
| 6,121,945 A | | 9/2000 | Tanaka et al. | 345/94 |
| 6,160,594 A | * | 12/2000 | Hanami et al. | 349/34 |
| 6,172,662 B1 | * | 1/2001 | Ito et al. | 345/94 |

FOREIGN PATENT DOCUMENTS

| | | |
|---|---|---|
| EP | 0 807 921 A1 | 11/1997 |
| JP | 57-66488 A | 4/1982 |
| JP | 60-173522a | 9/1985 |
| JP | 6-167947 | 6/1994 |

OTHER PUBLICATIONS

T.N. Ruckmongathan, "A Generalized Addressing Technique for RMS Responding Matrix LCDS," Conference Record of the 1988 International Display Research Conference, 1988, p. 82.

* cited by examiner

*Primary Examiner*—Don Wong
*Assistant Examiner*—Thuy Vinh Tran
(74) *Attorney, Agent, or Firm*—Oliff & Berridge, PLC

(57) ABSTRACT

An electro-optical device, such as a liquid crystal display device, includes a plurality of scanning electrodes and a plurality of signal electrodes wherein the plurality of scanning electrodes intersect the plurality of signal electrodes, wherein the scanning electrodes are organized into groups, each group having a plural number of scanning electrodes to be simultaneously selected, and scanning electrodes are selected on a group-by-group basis according to the MLS (Multi-Line Selection) scheme. The amplitude of voltages applied to the scanning electrodes is set to be equal to the amplitude of voltages applied to the signal electrodes. This allows circuits such as driving circuits, or a power supply circuit to be constructed in a simple fashion.

18 Claims, 20 Drawing Sheets

METHOD FOR DRIVING AN ELECTRO-OPTICAL DEVICE, DRIVING CIRCUIT FOR DRIVING AN ELECTRO-OPTICAL DEVICE, ELECTRO-OPTICAL DEVICE, AND ELECTRONIC APPARATUS

This is a Division of Application No. 09/403,498, filed Oct. 22, 1999, which in turn is a U.S. National Stage of PCT/JP99/00806 filed Feb. 22, 1999 which is now U.S. Pat. No. 6,426,594. The entire disclosure of the prior applications is hereby incorporated by reference herein in its entirety.

TECHNICAL FIELD

The present invention relates to a method for driving an electro-optical device such as a liquid crystal display device, a driving circuit for driving an electro-optical device, an electro-optical device, and an electronic apparatus.

BACKGROUND ART

First Background Art

A first background art associated with a method for driving a liquid crystal display device (based on a multi-line selection) is disclosed in International Application published as WO93/18501. In this method for driving a liquid crystal display device, a liquid crystal display panel includes scanning electrodes and signal electrodes arranged in a matrix such that the scanning electrodes and signal electrodes intersect each other, and pixels are formed in a matrix at intersections thereof. The scanning electrodes are organized into groups, each group consisting of a particular number of scanning electrodes which are selected at the same time, and the scanning electrodes are sequentially selected on a group-by-group basis. FIG. 6 illustrates an example of a set of waveforms for the case where four lines of scanning electrodes (four scanning electrodes) are selected at a time according to this driving method. In FIG. 6, Y1 to Y8 denote the waveforms of scanning voltages applied to the scanning electrodes, and X1 denotes the waveform of a signal voltage applied to a signal electrode. A selection voltage V3 or −V3 is applied to the scanning electrodes for a selection period (H) of each of four fields 1f–4f of one frame (F).

In this driving method, when there are a relatively large number of scanning electrodes, a liquid crystal of type 2 indicated in root-means-square voltage luminance characteristic of liquid crystal shown in FIG. 4 having a small value in terms of (saturation voltage)/(threshold voltage)=(Vs2/Vt2) is employed although a large driving voltage is required. In the case where there are a small number of scanning electrodes (for example when there are no more than about 32 scanning electrodes), a liquid crystal of type 1 having a low threshold voltage and having a large value in terms of (saturation voltage)/(threshold voltage)=(Vs1/Vt1) is employed so that the liquid crystal can be driven by a low voltage.

The operation of driving a liquid crystal of type 2 in accordance with the conventional method shown in FIG. 6 is discussed below. Herein, the liquid crystal is assumed to be driven by voltages which give a maximum value in terms of the ratio of the root-means-square value of on-voltage to the root-means-square value of off-voltage. More specifically, if a liquid crystal of type 2 with a threshold voltage Vt2 of 2.2 V is used and if the liquid crystal panel includes 64 lines of scanning electrodes, then V3 is set to about 6.7 V, and V2 to about 3.35 V. In the case where there are 120 scanning lines to be driven, V3 is set to about 8.9 V, and V2 to about 3.26 V. In any case, seven levels of driving voltages are required. Besides, the scanning electrode driving circuit is needed to output a high selection voltage. Thus, the difference between the selection voltage output from the scanning electrode driving circuit and the signal voltage output from the signal electrode driving circuit becomes great.

As a result, the conventional driving method requires a complicated power supply circuit and consumes a large amount of electric power. Furthermore, it is difficult to form both the scanning electrode driving circuit and the signal electrode driving circuit on a single IC chip. Referring to FIG. 14, a conventional power supply circuit is described below.

In this power supply circuit, a single input voltage Vcc relative to a ground voltage GND is input. A latch pulse LP is also input to the power supply circuit. Using Vcc and GND as power supply and in response to the latch pulse LP, a clock generator 21 generates a plurality of clock signals with different timing used by charge pump circuits. A negative sixfold boosting circuit 22 multiplies GND with respect to Vcc by 6 in a negative direction by means of charge pumping, thereby generating a voltage VEE. When Vcc=3.3 V, VEE becomes −16.5 V. In accordance with VEE, a contrast adjacent circuit 23 generates a selection voltage −V3 which gives optimum contrast. This selection voltage −V3 serves as a negative selection voltage applied to the scanning electrodes. A twofold boosting circuit 24 multiplies GND with respect to the selection voltage −V3 by 2 by means of charge pumping thereby generating a positive selection voltage V3. A negative twofold boosting circuit 25 multiplies GND with respect to Vcc by 2 in the negative direction by means of charge pumping thereby generating a voltage −V2. ½ dropping circuits 26 and 27 generate V1 by equally dividing between voltages Vcc and GND, and also generate −V1 by equally dividing between voltages GND and (−V3), by a charge pumping operation. GND is directly employed as a center voltage VC. A voltage V2 which is symmetric to −V2 about GND is generated by directly employing Vcc. Thus, all voltages required to drive the liquid crystal panel are obtained. In this power supply circuit, output voltages V3, V2, V1, VC, −V1, −V2, −V3 are symmetric about GND. A circuit 28 generates a voltage which is higher than −V3 by Vcc and supplies the resultant voltage as a logic voltage VDDy to the scanning electrode driving circuit.

In the conventional technique, seven levels of driving voltages used to drive the liquid crystal display device are generated in the above-described manner using the power supply circuit. However, as described above, the power supply circuit needs a very complicated circuit configuration.

The liquid crystal of type 1 shown in FIG. 4 with a smaller threshold voltage is also used because this type of liquid crystal can be driven with a smaller voltage and thus consumes lower power. However, although liquid crystal display devices with such a liquid crystal having a low threshold voltage can be driven by a low voltage, the ratio of the root-means-square value of on-voltage to the root-means-square value of off-voltage applied to the liquid crystal is large, and thus, it is difficult to deal with a large number of scanning lines. If an attempt to drive a large number of scanning electrodes is made, degradation in contrast and irregularity results. Therefore, the upper practical limit of the number of scanning lines which can be driven is about 16 to 32.

In the conventional optimized amplitude selective addressing method, each scanning electrode is selected once during each frame period. In contrast, in the driving method in which a plurality of lines are selected at a time, selection periods are equally distributed in terms of time over each frame, while retaining normal orthogonality in the selection of scanning lines. Furthermore, in this method, scanning electrodes are selected in such a manner that a particular group (block) including a predetermined number of scanning electrodes is selected at a time, so that selected scanning electrodes are spatially distributed. Herein, the term "normal" means that all scanning voltages have an equal root-means-square value amplitude) during each frame period. The term "orthogonal" means that when the amplitude of a voltage applied to a particular scanning electrode is multiplied by and added to the amplitude of a voltage applied to another arbitrary scanning electrode for respective selection periods over one frame period, the sum of the voltage amplitudes becomes 0. In simple matrix liquid crystal display devices, normal orthogonality is an essential prerequisite to the operation of turning each pixel on and off, independently of each other.

Second Background Art

A second background technique in the art of electro-optical devices such as a liquid crystal device is disposing a driving circuit in a single-chip form on either a substrate on which scanning electrodes (also called scanning lines or common electrodes) are arranged or a substrate on which signal electrodes (also called segment electrodes or data lines) are arranged, to drive these scanning electrodes and signal electrodes. In this technique, in order to connect all scanning electrodes and all signal electrodes to the output terminals of the single-chip type driving circuit, it is required that a large number of interconnection lines be disposed in a frame region surrounding an image display region on the substrate on which the driving circuit is mounted, wherein one end of each interconnection line is connected to a corresponding output terminal of the driving circuit. The scanning electrodes or the signal electrodes disposed on the other substrate are electrically connected to the opposite ends (up-to-down conducting terminals) of particular interconnection lines via up-to-down conducting members. The employment of the single-chip type driving circuit makes it possible to realize a small-sized low-cost electro-optical device which can be advantageously employed as, for example, a small-sized liquid crystal device for use in, for example, a portable telephone.

Japanese Unexamined Patent Publication No. 60-68371 discloses an electro-optical device such as a liquid crystal display device in which signal electrodes are arranged in a multiple-fold matrix on one substrate and scanning electrodes are arranged in the form of stripes on the other substrate. In this technique, if signal electrodes are disposed in an n-fold matrix (wherein n is an integer equal to or greater than 2), it becomes possible to increase the period during which a selection voltage is applied to each pixel by a factor of n compared to that employed in the common matrix scheme, and thus, it becomes possible to form an image with higher brightness and higher contrast ratio. The multiple-fold matrix structure may also be employed not for the data lines but for the scanning lines, as disclosed for example in Japanese Unexamined Patent Publication No. 58-143373.

In electro-optical devices of the above-described types, it is generally desirable that the size of the screen relative to the total device size be as large as possible. To meet this requirement, it is desirable that the image display region in which an image is displayed be formed on the substrate such that it becomes as large as possible relative to the frame region which surrounds the image display region and in which no image is displayed.

However, when the single-chip type driving circuit is employed, it is required that a great number of interconnection lines be disposed on the substrate in the frame region such that one end of each interconnection line is connected to the single-chip type driving circuit, and thus the frame region has a large area. The area of the frame region can be reduced by reducing the width of the interconnection lines. However, this result in an increase in the resistance of the interconnection lines and thus degradation occurs in image quality. Furthermore, it becomes required that the driving circuit have a higher voltage supplying capability.

In particular, when a single-chip type driving circuit is employed in a device in which scanning electrodes are disposed on one of two substrates and signal electrodes are disposed on the other substrates, it is required that the scanning electrodes or signal electrodes disposed on the substrate opposite to the substrate on which the driving circuit is formed be connected via up-to-down conducting members to the corresponding interconnection lines formed on the substrate on which the driving circuit is formed. To meet the above requirement, up-to-down conducting terminals must be formed in the frame region wherein each up-to-down conducting member occupies a certain area including a margin for an alignment error which can occur when two substrates are bonded to each other. This also makes it further difficult to reduce the area of the frame region.

If the pixel pitch is reduced (that is, the scanning electrode pitch and the signal electrode pitch are reduced) to meet the fundamental requirement for a higher-quality display image, it will be required to increase the number of interconnection lines. This makes it further difficult to reduce the area of the frame region in which the interconnection lines are disposed. Furthermore, the problems with the high interconnection resistance and the poor voltage supplying capability of the driving circuit become more serious.

Furthermore, in electro-optical devices employing the multiple-fold matrix technique described above, interconnection lines (scanning electrodes or signal electrodes) which are arranged in a multiple-fold matrix are formed essentially in a complex manner in the image display region. Therefore, it becomes very difficult to produce such an electro-optical device in particular when a small pixel pitch is required. With the reduction in the pixel pitch, the opening area (through which light passes to form an image) of each pixel becomes extremely narrow as a result of the reduction in distance between adjacent interconnections. Thus, it is thought that the reduction in the scanning electrode pitch or the signal electrode pitch (namely, the reduction in the pixel pitch) is impractical.

It is a general object of the present invention to solve the above problems. More specifically, it is an object of the present invention to provide a method for driving an electro-optical device, a driving circuit for driving an electro-optical device, an electro-optical device, and an electronic apparatus, using a reduced number of driving voltage levels thereby making it possible to form a high-quality image display with reduced electric power consumption. It is another object of the present invention to provide an electro-optical device having a structure which makes it possible to reduce the area of a frame region relative to the area of an image display region and which also makes it possible to rather easily reduce the pixel pitch.

DISCLOSURE OF INVENTION

According to an aspect of the present invention, to solve the problems with the background arts described above, a method of driving an electro-optical device is provided including a plurality of scanning electrodes and a plurality of signal electrodes, the plurality of scanning electrodes and the plurality of signal electrodes being arranged such that they intersect each other, the plurality of scanning electrodes being organized into groups, each group consisting of a plural number of scanning electrodes which are simultaneously selected, selection of scanning electrodes being sequentially performed on a group-by-group basis, wherein the amplitude of a voltage applied to the scanning electrodes is equal to the amplitude of a voltage applied to the signal electrodes.

This driving method allows a reduction in the driving voltage and also a reduction in the number of levels associated with the driving voltage. As a result, it becomes possible to reduce the total electric power consumed by a power supply circuit which generates the driving voltage, driving circuits, the liquid crystal panel, and the like. Furthermore, the power supply circuit and the driving circuits can be constructed in simpler fashions. Still furthermore, the scanning electrode driving circuit is allowed to have a smaller breakdown voltage. This allows a reduction in cost. Still furthermore, it becomes possible to combine the power supply circuit, the control circuit, the signal electrode driving circuit, the scanning electrode driving circuit, and the like, in an integral fashion on a single chip, which results in a reduction in the total size.

In a preferable mode in the above-described method of driving an electro-optical device, scanning voltages applied to the scanning electrodes include a non-selection voltage, a first selection voltage which is positive with respect to the non-selection voltage, and a second selection voltage which is negative with respect to the non-selection voltage, wherein maximum and minimum signal voltages applied to the signal electrodes are set to be equal to the first and second selection voltages described above. This makes it possible to use the maximum and minimum driving voltages in common for both the scanning electrode driving circuit and the signal electrode driving circuit, thereby reducing the number of levels associated with the driving voltages. Furthermore, because the amplitude of the voltage is equal for both driving circuits, the driving circuits are allowed to have an equal breakdown voltage, and thus, it becomes possible to integrate both driving circuits on a single chip.

In the above-described method of driving an electro-optical device, the electro-optical device may be a liquid crystal display device, wherein it is preferable to employ a liquid crystal having a characteristic satisfying the condition: (root-means-square value of on-voltage applied to the liquid crystal)/(root-means-square value of off-voltage applied to the liquid crystal)≧(saturation voltage of the liquid crystal)/(threshold voltage of the liquid crystal), as a liquid crystal of the liquid crystal display device. This makes it possible to achieve high contrast using reduced driving voltages.

In the above-described method of driving an electro-optical device, the power supply circuit for generating the scanning voltages and the signal voltages preferably includes a voltage boosting circuit for generating the first selection voltage by boosting the non-selection voltage and the second selection voltage, a first voltage dropping circuit for generating the signal voltage having a voltage level between the second selection voltage and the non-selection voltage, and a second voltage dropping circuit for generating the signal voltage having a voltage level between the non-selection voltage and the second selection voltage. This allows simplification in terms of the circuit configuration of the power supply circuit compared with the conventional power supply circuit. Furthermore, it becomes possible to integrate the power supply circuit together with the driving circuits on a single-chip integrated circuit.

In the above-described method of driving an electro-optical device, it is preferable that the scanning electrode driving circuit for applying selection voltages to the scanning electrodes and the signal electrode driving circuit for applying signal voltages to the signal electrodes be integrated on a single-chip driving circuit IC. The integration of the scanning electrode driving circuit and the signal electrode driving circuit into the form of a single-chip integrated circuit results in a reduction in the total size of the device.

In the above-described method of driving an electro-optical device, of the scanning electrode driving circuit for applying selection voltages to the scanning electrodes, the signal electrode driving circuit for applying signal voltages to the signal electrodes, and the power supply circuit for generating the selection voltages and the signal voltages, at least two circuits may preferably be integrated on a single-chip driving circuit IC. This allows a reduction in the number of integrated circuits used, and thus a reduction in the total size of the device.

In the above-described method of driving an electro-optical device, it is preferable that selection voltages used to select respective scanning electrodes be distributed and applied within one frame period. This allows an improvement in contrast and thus an improvement in quality of an image such as a still image displayed since selection periods are distributed within frame periods.

In the above-described method of driving an electro-optical device, it is also preferable that selection voltages used to select respective scanning electrodes be applied continuously during a predetermined period in one frame period. If this method is employed, when display data is read from a memory to create a signal voltage applied to the signal electrode in accordance with the display data, the display data becomes equal during the predetermined period. This means that the display data is held during the above-described predetermined period. This results in a reduction in the number of times that display data is read, and thus it becomes possible to reduce electric power consumed when display data is read.

In the above-described method of driving an electro-optical device, it is preferable that the plural number of scanning electrodes which are selected at the same time include a virtual scanning electrode, and the number of actual scanning electrodes which are equal to the plural number minus the number of virtual scanning electrodes are selected at the same time. For example, when the plural number of scanning electrodes which are selected at the same time is equal to eight, there may be for example one virtual scanning electrode. In this case, seven actual scanning electrodes are selected at the same time and thus the number of levels associated with the driving voltage can be reduced to five from the eleven which would otherwise be required.

In the above-described method of driving an electro-optical device, it is preferable that the plural number of scanning electrodes which are selected at the same time be equal to four. In this case, the number of levels associated with the driving voltage can be reduced to five. Alternatively, the plural number of scanning electrodes which are selected at the same time may preferably be equal to seven. In this case, the number of levels associated with the driving voltage can also be reduced to five.

In the above-described method of driving an electro-optical device, the scanning electrodes and the signal electrodes may preferably be arranged such that they intersect each other in a multiple-fold matrix. This allows a reduction in the number of scanning electrodes or the signal electrodes, and thus it becomes possible to simplify the circuit configuration of the driving circuits.

In the above-described method of driving an electro-optical device, it is preferable that a substrate on which the scanning electrodes are formed and a substrate on which the signal electrodes are formed be disposed such that they oppose each other, a single-chip driving circuit IC, including the scanning electrode driving circuit for applying selection voltages to the scanning electrodes and the signal electrode driving circuit for applying signal voltages to the signal electrodes in an integrated fashion, be mounted on one of the above-described two substrates, and the one of the two substrates be connected to the other substrate via an up-to-down conducting member. This allows a reduction in the size of the frame region of the electro-optical device.

According to another aspect of the present invention, an electro-optical device is provided including a plurality of scanning electrodes and a plurality of signal electrodes, the plurality of scanning electrodes and the plurality of signal electrodes being arranged such that they intersect each other, the plurality of scanning electrodes being organized into groups, each group consisting of a plural number of scanning electrodes which are simultaneously selected, selection of scanning electrodes being sequentially performed on a group-by-group basis, wherein: the electro-optical device includes a scanning electrode driving circuit for applying a scanning voltage to the scanning electrodes and also includes a signal electrode driving circuit for applying a signal voltage to the signal electrodes; and the amplitude of a voltage applied to the scanning electrodes is equal to the amplitude of a voltage applied to the signal electrodes.

This construction of the electro-optical device allows a reduction in the driving voltage and also a reduction in the number of levels associated with the driving voltage. As a result, it becomes possible to reduce the total electric power consumed by a power supply circuit which generates the driving voltage, driving circuits, a liquid crystal panel, and the like. Furthermore, the power supply circuit and the driving circuits can be constructed in simpler fashions. Still furthermore, the scanning electrode driving circuit is allowed to have a smaller breakdown voltage. This allows a reduction in cost. Still furthermore, it becomes possible to combine the power supply circuit, the control circuit, the signal electrode driving circuit, the scanning electrode driving circuit, and the like, in an integral fashion on a single chip, which results in a reduction in the total size.

In a preferable mode of the above-described electro-optical device, scanning voltages applied to the scanning electrodes include a non-selection voltage, a first selection voltage which is positive with respect to the non-selection voltage, and a second selection voltage which is negative with respect to the non-selection voltage, wherein maximum and minimum signal voltages applied to the signal electrodes are set to be equal to the first and second selection voltages described above. This makes it possible to use the maximum and minimum driving voltages in common for both the scanning electrode driving circuit and the signal electrode driving circuit, thereby reducing the number of levels associated with the driving voltages. Furthermore, because the amplitude of the voltage is equal for both driving circuits, the driving circuits are allowed to have an equal breakdown voltage, and thus, it becomes possible to integrate both driving circuits on a single chip.

In the above-described electro-optical device, the electro-optical device may be a liquid crystal display device, wherein it is preferable to employ a liquid crystal having a characteristic satisfying the condition: (root-means-square value of on-voltage applied to the liquid crystal)/(root-means-square value of off-voltage applied to the liquid crystal)≧(saturation voltage of the liquid crystal)/(threshold voltage of the liquid crystal), as a liquid crystal of the liquid crystal display device.

In the above-described electro-optical device, the power supply circuit for generating the scanning voltages and the signal voltages preferably includes a voltage boosting circuit for generating the first selection voltage by boosting the non-selection voltage and the second selection voltage, a first voltage dropping circuit for generating a signal voltage having a voltage level between the second selection voltage and the non-selection voltage, and a second voltage dropping circuit for generating a signal voltage having a voltage level between the non-selection voltage and the second selection voltage. This allows simplification in terms of the circuit configuration of the power supply circuit compared with the conventional power supply circuit. Furthermore, it becomes possible to integrate the power supply circuit together with the driving circuits on a single-chip integrated circuit.

In the above-described electro-optical device, of the scanning electrode driving circuit for applying selection voltages to the scanning electrodes, the signal electrode driving circuit for applying signal voltages to the signal electrodes, and the power supply circuit for generating the selection voltages and the signal voltages, at least two circuits may preferably be integrated on a single-chip driving circuit IC. This allows a reduction in the number of integrated circuits used, and thus a reduction in the total size of the device.

In the above-described electro-optical device, the scanning electrodes and the signal electrodes may be arranged such that they intersect each other in a multiple-fold matrix. This allows a reduction in the number of scanning electrodes or the signal electrodes, and thus it becomes possible to simplify the circuit configuration of the driving circuits.

In the above-described electro-optical device, it is preferable that a substrate on which the scanning electrodes are formed and a substrate on which the signal electrodes are formed be disposed such that they oppose each other, a single-chip driving circuit IC, including the scanning electrode driving circuit for applying selection voltages to the scanning electrodes and the signal electrode driving circuit for applying signal voltages to the signal electrodes in an integrated fashion, be mounted on one of the above-described two substrates, and the one of the two substrates be connected to the other substrate via an up-to-down conducting member. This allows a reduction in the size of the frame region of the electro-optical device.

According to still another aspect of the present invention, a driving circuit for driving an electro-optical device is provided including a plurality of scanning electrodes and a plurality of signal electrodes, the plurality of scanning electrodes and the plurality of signal electrodes being arranged such that they intersect each other, the plurality of scanning electrodes being organized into groups each consisting of a plural number of scanning electrodes which are simultaneously selected, selection of scanning electrodes being sequentially performed on a group-by-group basis, wherein the driving circuit includes a scanning electrode driving circuit for applying a scanning voltage to the scanning electrodes and also includes a signal electrode driving circuit for applying a signal voltage to the signal electrodes; the amplitude of the voltage applied to the scanning electrodes is equal to the amplitude of the voltage applied to the signal electrodes; and the scanning electrode driving circuit and the signal electrode driving circuit are integrated on a single-chip integrated circuit.

According to the present invention, this above described construction of the driving circuit allows a reduction in the driving voltage and also a reduction in the number of levels associated with the driving voltage. As a result, it becomes possible to reduce the total electric power consumed by a power supply circuit which generates the driving voltage, driving circuits, a liquid crystal panel, and the like. Furthermore, the power supply circuit and the driving circuits can be constructed in simpler fashions. Still furthermore, the scanning electrode driving circuit is allowed to have a smaller breakdown voltage. This allows a reduction in cost. Still furthermore, a reduction in the total size can be achieved as a result of the integration of the signal electrode driving circuit and the scanning electrode driving circuit on a single chip.

According to still another aspect of the present invention, there is provided an electro-optical device including: a pair of first and second substrates; a plurality of signal electrode means formed in an image display region on the first substrate, each signal electrode means including a plurality of pixel electrode sections; a plurality of scanning electrode means formed in the image display region on the second substrate, the plurality of scanning electrode means being arranged such that each of them intersects a plural number of adjacent pixel electrode sections located in a direction in which the plurality of signal electrode means are disposed; a driving circuit in the form of a single chip for driving the plurality of signal electrode means and the plurality of scanning electrode means, the driving circuit being connected to a predetermined point located on either the first or second substrate in a frame region surrounding the image display region; a plurality of first interconnection lines formed on either the first or second substrate in the frame region, the plurality of first interconnection lines connecting the driving circuit to one end of each of the plurality of signal electrode means; a plurality of up-to-down conducting means disposed between the first and second substrates in the frame region, the plurality of up-to-down conducting means being connected to the end portions of the respective plurality of scanning electrode means, the end portions being located in the frame region; and a plurality of second interconnection lines formed on either the first or second substrate in the frame region, the plurality of second interconnection lines connecting the driving circuit to the plurality of up-to-down conducting means.

In this electro-optical device according to the present invention, a plurality of electrodes are formed in a multiple-fold matrix in the image display region, and the driving circuit in the single-chip form is mounted on a substrate at a predetermined location in the frame region and at the side of one end of the signal electrode means. In the frame region, one end, adjacent to the above-described described predetermined location, of each of the plurality of signal electrode means is connected to the driving circuit via the corresponding first interconnection line. This makes it unnecessary to extend the first interconnection lines over long paths around the image display region. That is, the first interconnection lines are required to be formed only along short paths. When the electrodes are formed in an n-fold matrix (where n is an integer equal to or greater than 2), the width of each scanning electrode means is set to be equal to the total length of n pixels so that each scanning electrode means opposes an array of pixels formed with adjacent n signal electrode means. In this case, the total number of scanning electrode means becomes 1/n times the number of scanning electrode means which are required in the non-multiple matrix structure (that is, a single-fold matrix structure). The end of each of the reduced number of scanning electrode means is connected, in the frame region, to the corresponding up-to-down conducting means which is in turn connected to the driving circuit via the corresponding second interconnection line. Thus, the total number of second interconnection lines is reduced to a value as small as about 1/n times the number of second interconnection lines which are required in the non-multiple matrix structure. As a result, the area occupied in the frame region by the second interconnection lines can be reduced by a factor of about 1/n. That is, although the driving circuit is of the single-chip type, it is possible to effectively minimize the increase in the area occupied, in the frame region, by the second interconnection lines. On the other hand, because each scanning electrode means has a width n times the size of one pixel, high-precision microfabrication technology is not required. Thus, it becomes possible to combine the single-chip driving circuit with the signal electrode means in the multiple-fold matrix form.

According to the present invention, as described above, it is possible to reduce the frame region relative to the image display region by employing the first interconnection lines extending along rather short paths and a reduced number of second interconnection lines. Besides, the plurality of up-to-down conducting means, which occupy a particular area in the frame region and which are required to be formed taking into account the alignment error which can occur when the first and second substrates are bonded to each other, are formed such that one up-to-down conducting means is formed for each of the scanning electrode means, the total number of which is reduced by a factor of 1/n, where n is the degree of multiplicity. Therefore, the total number of up-to-down conducting means can also be reduced by a factor of about 1/n, and thus, it becomes possible to further reduce the size of the frame region. Furthermore, the employment of the first interconnection lines extending along rather short paths and the reduced number of second interconnection lines makes it possible to minimize the total interconnection resistance from the driving circuit to the scanning electrode means or the signal electrode means. Thus, degradation of the image signal due to the increase in the interconnection resistance can be prevented. Furthermore, it also becomes possible to display a high-quality image using a driving circuit with a rather low driving capability or a driving circuit with a low breakdown voltage. The electric power consumed during the driving operation can also be reduced. Furthermore, the selection time period of the image signal during one frame can be increased by a factor of n, wherein n is the degree of multiplicity. Thus, the driving voltage may also be reduced by reducing the duty ratio. In this case, the actual effects is kept in which contrast ratio and luminance of the image displayed can also be enhanced.

According to the present invention, as described above, it is possible to reduce the size of the frame region relative to the image display region, and it is also possible to rather easily reduce the pixel pitch. It is also possible to display a high-quality image using a driving circuit with a rather low driving capability, or a driving circuit with a low breakdown voltage. This allows a reduction in the total power consumption of the device.

In the above-described electro-optical device, it is preferable that the plurality of scanning electrode means extend, in an interdigital fashion, from both sides of the image display region toward the inner area of the image display region. This allows a reduction in the number of up-to-down conducting members disposed at one side of the image display region to a value one-half the total number of scanning electrode means. Furthermore, it allows disposing of a half of second interconnection lines on the first substrate in an area of the frame region at one side of the image display region, and another half at the opposite side of the image display region. This allows the second interconnection lines to be equally distributed on both sides within the frame region surrounding the image display region. Thus, second interconnection lines, each having a particular width, and up-to-down conducting means, each having a particular area, can be disposed in an efficient fashion within the frame region which is limited in area.

In the above-described electro-optical device, it is preferable that the image display region be longer in a direction along the signal electrode means than in a direction along the scanning electrode means, and the signal electrode means and the scanning electrode means be formed such that the number of pixels formed in the image display region along the signal electrode means is greater than the number of pixels along the scanning electrode means. In this arrangement, the respective signal electrode means with the multiple-fold matrix structure extend in the longitudinal direction of the image display region, and thus the total number and the length of first interconnection lines, each connected to one end near the driving circuit of the corresponding signal electrode means, can be fixed regardless of the length of the image display region in the longitudinal direction thereof. As for the total number of scanning electrode means (that is the total number of second interconnection lines), it is required to increase only one scanning electrode means (that is, one second interconnection line) each time the number of pixels in the longitudinal direction is increased by n. In this case, it is required to increase the length of the second interconnection lines only by an amount corresponding to the increase in the length of the image display region in the longitudinal direction. Thus, the present invention provides greater advantages in particular when the length of the image display region in the longitudinal direction becomes longer.

In the above-described electro-optical device, it is preferable that each up-to-down conducting means includes an up-to-down conducting member disposed between the first and second substrates, and an up-to-down conducting terminal formed on either one of the first and second substrates, the up-to-down conducting terminal being in contact with the up-to-down conducting member and being connected to one end of a corresponding second interconnection line. In this arrangement, scanning electrode means are connected to the corresponding up-to-down conducting members disposed between the first and second substrates, wherein the up-to-down conducting members are connected to the corresponding up-to-down conducting terminals, which are in turn connected to the respective ends of the corresponding second interconnection lines formed on the first substrate, so that the driving circuit can supply a driving voltage to the scanning electrode means via the second interconnection lines, the up-to-down conducting terminals, and the up-to-down conducting members, thereby driving the scanning electrode means. Furthermore, it is possible to reduce the total number of up-to-down connecting terminals which occupy a particular area in the frame region, and which are required to be formed taking into account the alignment error which can occur when the first and second substrates are bonded to each other, by a factor of 1/n. This makes it very easy to reduce the size of the frame region in which the up-to-down connecting terminals are disposed.

In the above-described electro-optical device, it is preferable that each of the plurality of signal electrode means includes pixel electrodes, a signal interconnection line connected to the pixel electrodes, and two-terminal non-linear elements connected between the respective pixel electrodes and the signal electrode. This makes it possible to drive the respective pixel electrodes by means of switching via two-terminal non-linear elements such as TFDs (Thin Film Diodes), thereby displaying a high-quality image with high contrast, which makes the active matrix driving possible.

In the above-described electro-optical device, it is preferable that the driving circuit is mounted on the first substrate. This makes it possible to realize a small-sized light-weight low-power electro-optical device including a driving circuit mounted on a first substrate by means of the COG (Chip On Glass) technique.

In the above-described electro-optical device, it is preferable that input terminals be formed at the predetermined location on either the first or second substrate such that the input terminals are connected to the first and second interconnection lines, and that the driving circuit be connected to the input terminals via particular connection means. In this electro-optical device, because the driving circuit is connected to the first substrate via particular connection means such as a TAB (Tape Automated Bonding) film, a dedicated connector, or an ACF (Anisotropic Conductive Film), it becomes possible to design the electro-optical device in various fashions as required, and a reduction in cost can be achieved.

In the above-described electro-optical device, the signal electrode means and the scanning electrode means may be replaced with each other. In this case, the scanning electrode means are formed in a multiple-fold matrix on the first substrate on which the driving circuit is mounted, and thus it is possible to reduce the number of up-to-down conducting means connected to the signal electrode means formed on the second substrate, and it is also possible to reduce the number of second interconnection lines. This allows the pixel pitch to be relatively easily reduced while reducing the size of the frame region relative to the image display region. Furthermore, it also becomes possible to display a high-quality image using a driving circuit having a low breakdown voltage and low voltage supply capability. A reduction in the total power consumption is also achieved. Furthermore, it is possible to display a high-quality image using a driving circuit having low capability of driving the signal electrode means (that is, capability of supplying the image signal voltage).

The present invention also provides an electronic apparatus using any electro-optical device described above as a display device. This makes it possible to realize an electronic apparatus including a display device with a small frame region.

BEST MODE FOR CARRYING OUT THE INVENTION

Embodiments of the present invention are described below with reference to the accompanying drawings.

First Embodiment

Figure 5:
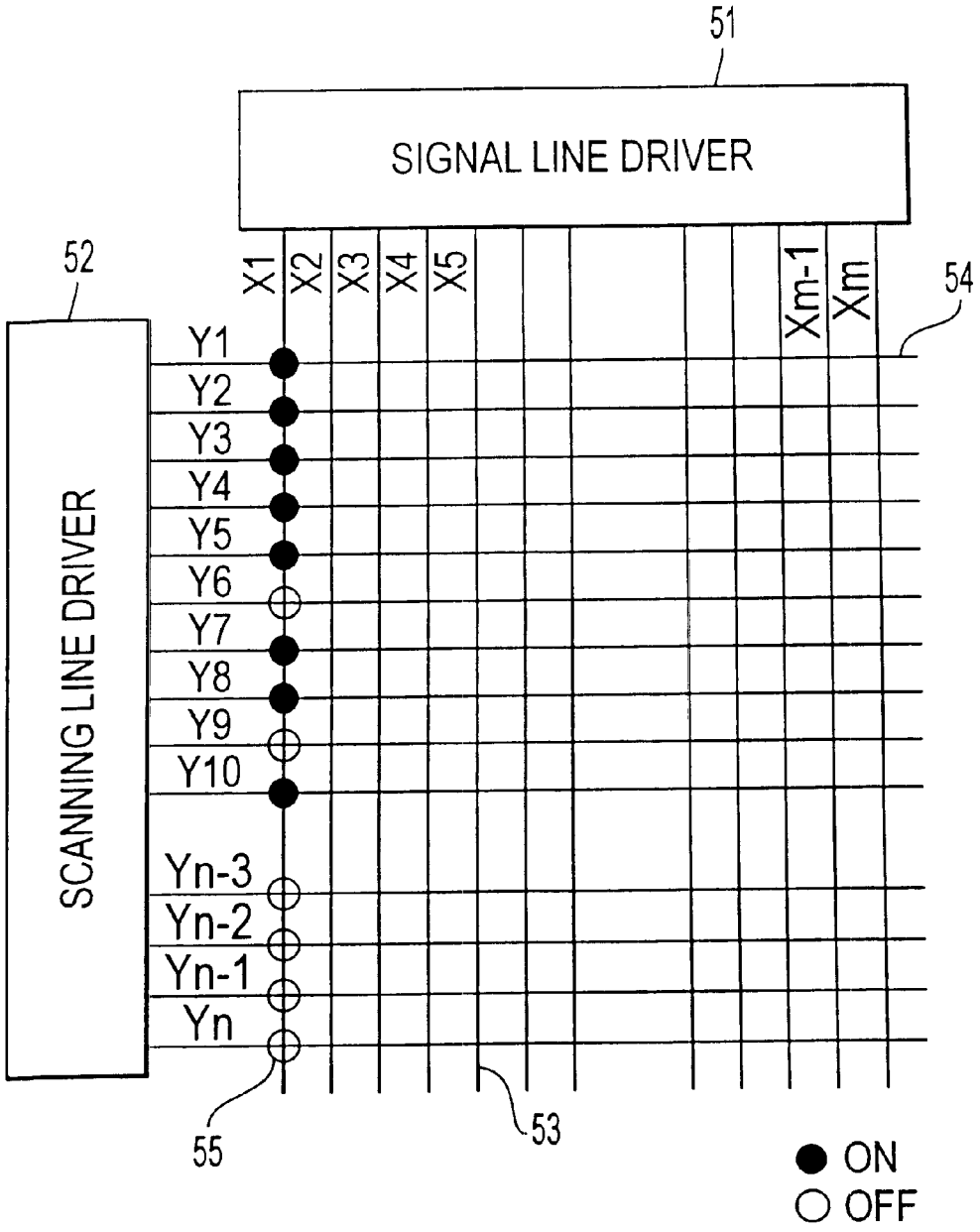
FIG. 5 is a block diagram illustrating an example of a liquid crystal display device.

FIG. 5 is a block diagram illustrating a liquid crystal display device which is an example of an electro-optical device according to a first embodiment of the present invention. In the liquid crystal display device of the present embodiment, a first substrate having scanning electrodes 54 (Y1–Yn) formed on the inner surface thereof and a second substrate having signal electrodes 53 (X1–Xn) formed on the inner surface thereof are disposed such that they oppose each other. An STN (super twisted nematic) liquid crystal whose molecules are aligned at a twist angle equal to or greater than 180° is disposed between the pair of substrates described above. In this liquid crystal device, polarizers are disposed outside the pair of substrates such that one polarizer is located on one side and the other polarizer is located on the opposite side. A retardation film is disposed at least between either one of the polarizers and the corresponding substrate. In the present embodiment, the liquid crystal display device is, by way of example, of the reflective type having a reflector disposed on the outer surface of the polarizer located on a side opposite to the viewing side, wherein the image becomes black when a voltage is applied to the liquid crystal. Referring to FIG. 5, a scanning line driver (also called a scanning electrode driving circuit or Y driver) 52 applies a scanning voltage waveform, which will be described later, to the scanning electrodes 54, and a signal line driver (also called a signal electrode driving circuit or X driver) 51 applies a signal voltage waveform, which will be described later, to the signal electrodes 53. Pixels are arranged in a matrix at respective intersections of the scanning electrodes 54 and the signal electrodes 53. The difference between the scanning voltage waveform and the signal voltage waveform is applied as a root-means-square voltage across the liquid crystal at the pixels. If a root-means-square voltage greater than the threshold voltage of the liquid crystal is applied, the corresponding pixel goes into an on-state (black-display state). Conversely, when the applied root-means-square voltage is lower than the threshold voltage, the corresponding pixel is in an off-state (white-display state, or a state representing a particular color assigned to the pixel in the case of a color display device). The liquid crystal display device may also be of a transmissive type in which pixels go into an off-state when a root-means-square voltage higher than the threshold voltage of the liquid crystal is applied, and pixels are in an on-state when the applied root-means-square voltage is lower than the threshold voltage.

Figure 1:
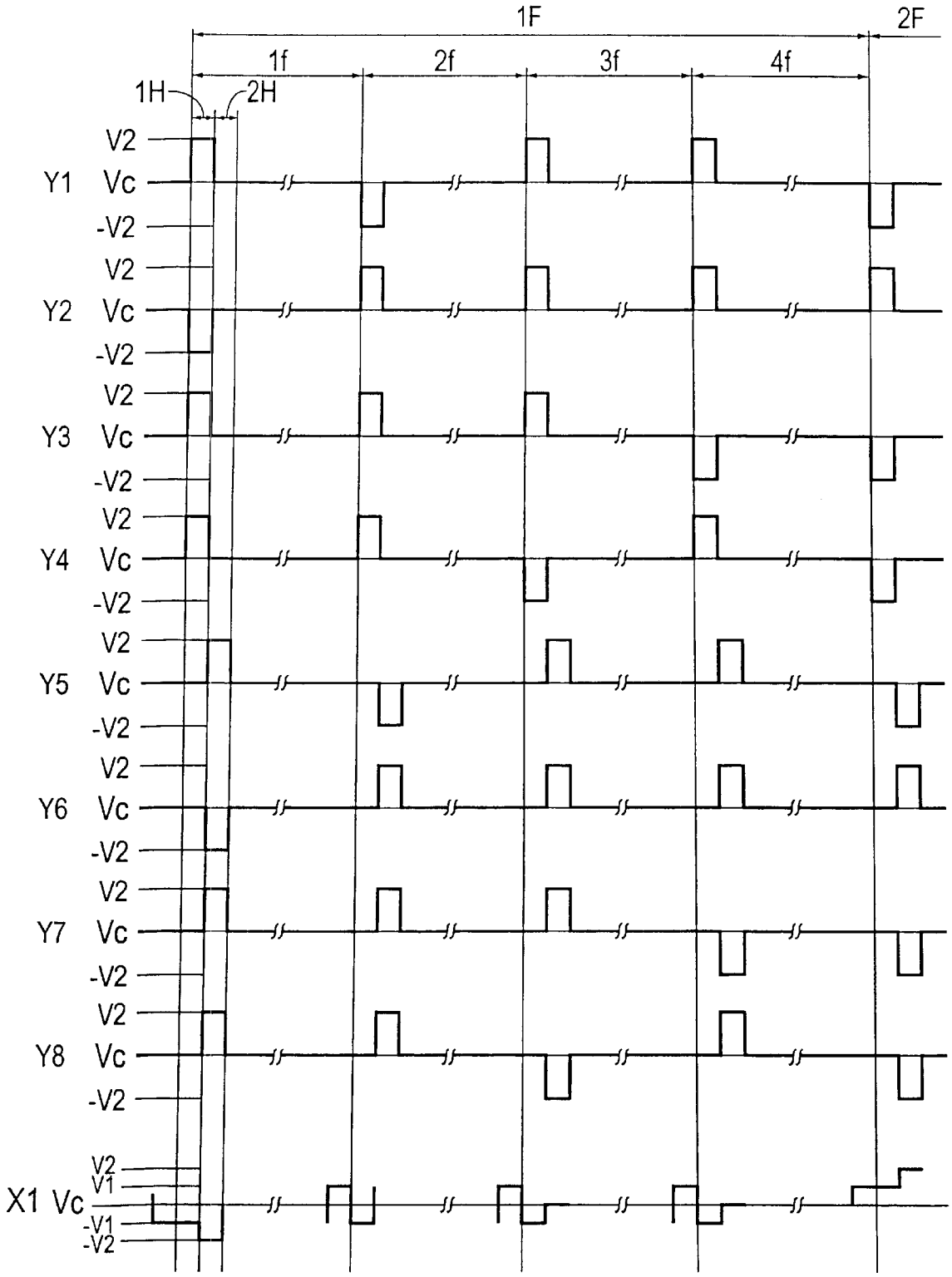
FIG. 1 is a wave-form chart illustrating an example of a method of driving a liquid crystal display device according to a first embodiment of the present invention.

FIG. 1 illustrates driving waveforms employed in the liquid crystal display device shown in FIG. 5. In the driving method shown in FIG. 1, scanning electrodes are selected group by group (by means of multi-line selection), wherein four scanning electrodes (four lines) are selected at a time. Selection voltages are applied to the scanning electrodes simultaneously selected, in accordance with a normal orthogonal matrix, such that the signal polarities of the selection voltages are orthogonal to each other during a particular period (for example, the selection voltage applied to one of four lines selected at the same time has a signal polarity opposite to that of the selection voltages applied to the remaining three lines, and each line is selected four times during each frame period, wherein the selection voltage in one of the four applications has a signal polarity opposite to that in the remaining three applications). In this driving method, selection periods (H), during each of which one line is selected, are periodically distributed over one frame period (1F) so that each line is selected once in each of four fields 1f–4f constituting one frame. Y1–Y8 denote scanning voltage waveforms which are applied to the respective scanning electrodes Y1–Y8 of the liquid crystal display device shown in FIG. 5 in the form of a block diagram. X1 denotes a signal voltage waveform which is applied to the signal electrode denoted by X1 in FIG. 5 to display an image along the signal electrode X1 as shown in FIG. 5.

This driving method is different from the conventional driving method in that the selection voltage of the scanning voltage waveform has the same amplitude as that of the signal voltage waveform, as shown in FIG. 1. More specifically, with respect to Vc (0 V for example), the positive selection voltage level V2 of the scanning voltage waveform is set to be equal to the positive voltage level V2 of the signal voltage waveform. Similarly, the negative selection voltage level −V2 of the scanning voltage waveform is set to be equal to the negative voltage level −V2 of the signal voltage waveform. As a result, the number of driving voltage levels is reduced to five from the seven levels which are required in the driving method shown in FIG. 6.

Figure 4:
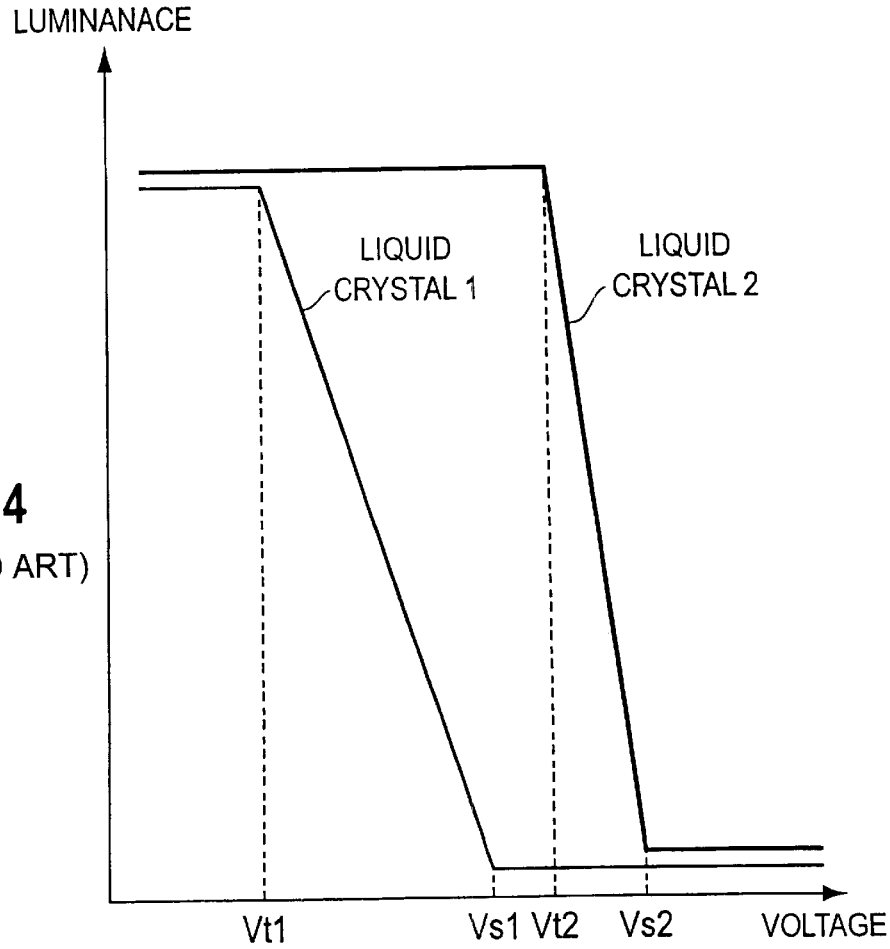
FIG. 4 (RELATED ART)
FIG. 4 is a graph illustrating an example of an optical characteristic of liquid crystals in terms of luminance as a function of the root-means-square voltage applied to the liquid crystal.

The characteristics of the liquid crystal used are described below. FIG. 4 illustrates an optical characteristic of the liquid crystal. More specifically, luminance is shown as a function of the root-means-square voltage applied to the liquid crystal. Vt1 and Vt2 denote voltages (threshold voltages) at which a bright-to-dark transition occurs in the pixels of the liquid crystal display device when the root-means-square voltage applied to the liquid crystal is changed. Vs1 and Vs2 denote voltages (saturation voltages) at which the pixels of the liquid crystal display device reach an ultimately dark state after gradually becoming dark in response to the increase in the root-means-square voltage applied to the liquid crystal. The liquid crystal 1 has a lower threshold voltage and the liquid crystal 2 has a higher threshold voltage.

Of the two types of liquid crystals described above, the liquid crystal of type 2 is employed in the present invention. The liquid crystal of this type has a relatively high threshold voltage Vt2 and has a relatively low ratio of Vs2 to Vt2. Therefore, this liquid crystal can be driven while maintaining high contrast, even when there are a large number of scanning electrodes. More specifically, the liquid crystal 2 has a threshold voltage Vt2 of about 2.2 V and a saturation voltage Vs2 of about 2.31 V, and thus, the ratio of Vs2 to Vt2 becomes 1.05.

In the present embodiment, by applying the driving method according to the present invention to the liquid crystal of type 2, it becomes possible to realize a high-contrast liquid crystal display device which can operate at a low driving voltage, as will be described in further detail below.

For example, when there are 64 scanning electrodes, the voltages applied to the liquid crystal according to the driving method of the present invention become such that V2 is about 4.1 V and V1 is about 2.05 V, if Vc=0. In this case, the ratio of the root-means-square value of on-voltage to the root-means-square value of off-voltage applied to the liquid crystal becomes about 1.105, and thus, Vs2/Vt2=1.05<1.105. This ensures that high enough contrast can be achieved.

In the case where there are 120 scanning electrodes, the voltages applied to the liquid crystal according to the driving method of the present invention become such that V2 is about 4.4 V and V1 is about 2.2 V, if Vc=0. In this case, the ratio of the root-means-square value of on-voltage to the root-means-square value of off-voltage applied to the liquid crystal becomes about 1.06, and thus, Vs2/Vt2=1.05<1.06. Therefore, also in this case, high enough contrast can be achieved.

Example of Construction of Scanning Electrode Driving Circuit

Figure 9A:
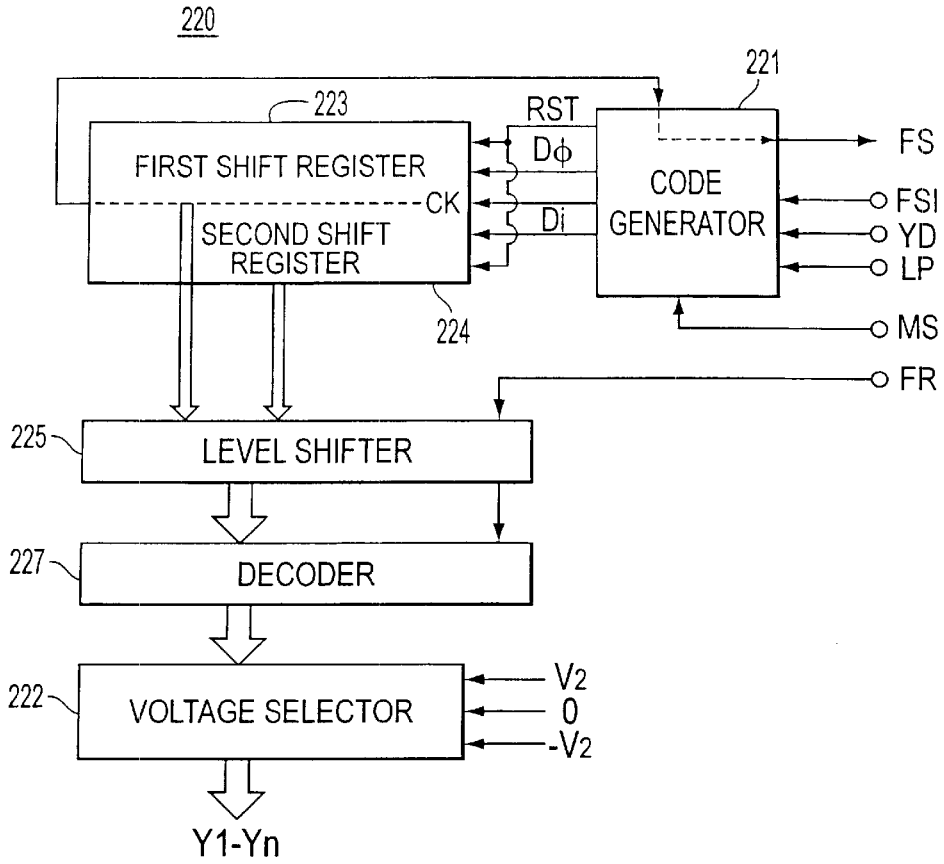
FIG. 9A is a block diagram illustrating a scanning electrode driving circuit (Y driver) of a liquid crystal display device according to the present invention.

Referring now to FIG. 9A, a scanning electrode driving circuit (Y driver) 220 according to the present embodiment is described below, wherein the scanning electrode driving circuit 220 corresponds to the scanning line driver 52 shown in FIG. 5. In this specific embodiment, it is assumed that there are 120 scanning electrodes. The scanning electrode driving circuit 220 is a semiconductor integrated circuit including a code generator 221 for generating a column pattern of voltage selection associated with scanning electrodes for each field in accordance with a frame start pulse YD and a latch pulse LP supplied from a control circuit (not shown) which generates a timing signal and display data used to drive the liquid crystal display device in response to a control signal and display data supplied form a MPU or the like. The scanning electrode driving circuit 220 also includes other various circuits which will be described later.

In the present embodiment, voltages applied to the scanning electrodes Y1–Yn are V2 or −V2 during selection periods and 0 V during non-selection periods. That is, there are three voltage levels in total. To generate these three voltage levels, it is required to supply selection control information consisting of two bits for each scanning electrode Y1–Yn to a voltage selector 222. Thus, the code generator 221 generates codes to select a plurality of lines at a time. More specifically, in response to a frame start pulse YD, the code generator 221 initializes a field counter (not shown) and first and second shift registers 223 and 224. After that, the code generator 221 generates 2-bit voltage selection codes D0 and D1 indicating a column pattern of selected voltages to be applied to the respective scanning electrodes during a first field. The resultant voltage selection codes D0 and D1 are transferred to the first and second shift registers 223 and 224 serving as serial-to-parallel converters. The first shift registers 223 and the second shift registers 224 are 120-bit shift registers, respectively, capable of handling as many bits as required to drive the scanning electrodes. In response to the same shift clock CK, the first shift register 223 stores the voltage selection code D0 at the low-order bit and the second shift register 224 stores the voltage selection code D1 at the high-order bit. In the above process, the shift clock CK is generated by a timing generator (not shown) in the code generator 221. In the present embodiment, instead of employing a single 240-bit shift register which operates in response to the shift clock CK, two 120-bit shift registers 223 and 224 are employed operating in parallel in response to the shift clock CK. This allows the shift registers 223 and 224 to operate at a low frequency in response to latch pulse LP with extremely reduced power consumption.

The voltage selection codes D0 and D1 of each bit applied to the first shift register 223 and the second shift register 224 are shifted to adjacent bits in response to the shift clock CK wherein outputs are maintained unchanged for a selection period Δt. The outputs of the shift registers are supplied to a level shifter 225 and converted from low logic swing levels to high logic swing levels. The voltage selection codes D0 and D1 with high logic swing levels output from the level shifter 225 are supplied, together with a liquid crystal alternating signal FR which was also converted in terms of the level at the same time, to a decoder 227 serving as a waveform generator. In response, the decoder 227 generates a selection control signal. The voltage selector 222 is turned on and off in response to the selection control signal from the decoder 227 so that one of voltages V2, Vc (0 V), and −V2 described above with reference to FIG. 1 is applied to the respective scanning electrodes Y1–Yn.

Figure 10:
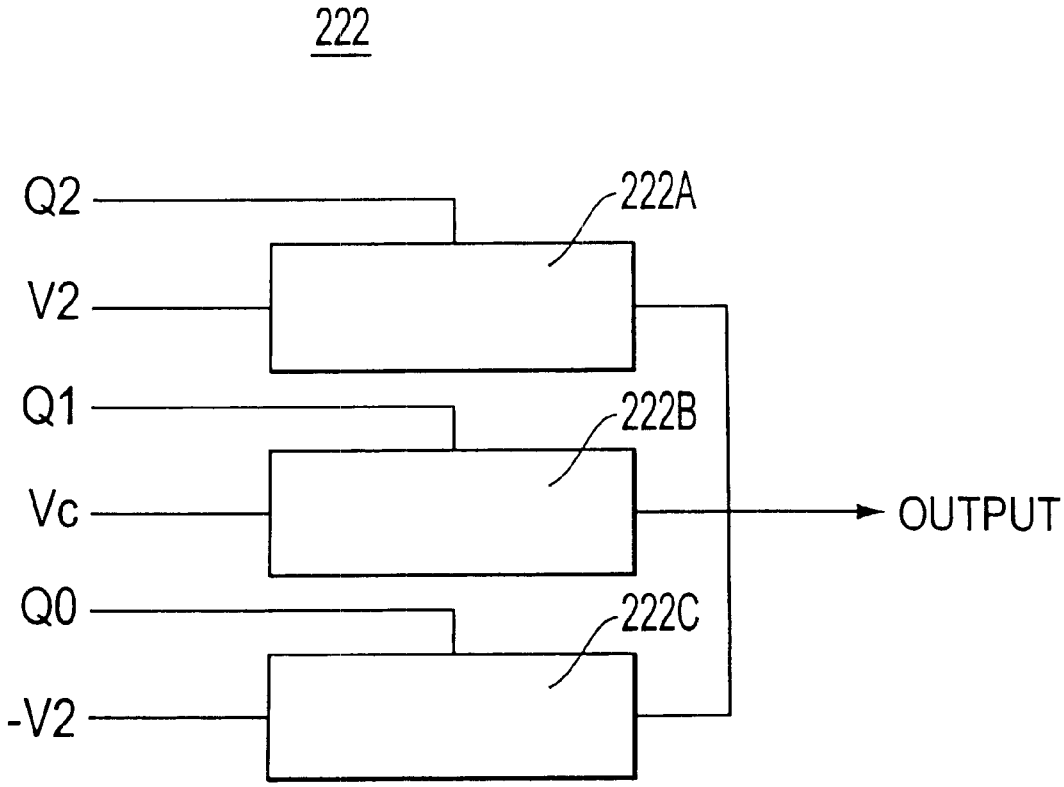
FIG. 10 is a block diagram illustrating a voltage selector used in a scanning electrode driving circuit.

FIG. 10 is a block diagram illustrating the voltage selector 222. The voltage selector 222 includes an analog switch 222A, an analog switch 222B, and an analog switch 222C, wherein voltages V2, Vc, and −V2 are supplied to the analog switches 222A, 222B, and 222C, respectively, from a power supply circuit which will be described later. Selection control signals Q2, Q1, and Q0 are input to the respective analog switches.

Figure 9B:
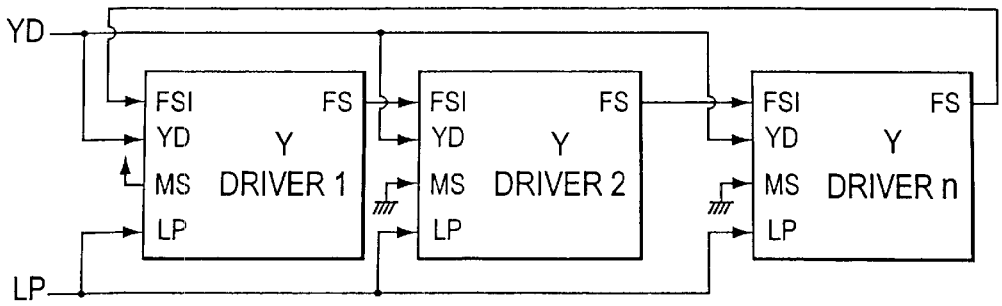
FIG. 9B is a connection diagram associated with a plurality of cascaded scanning electrode driving circuits (Y drivers)

In the present embodiment, a plurality of scanning electrode driving circuits (Y drivers 1–n) can be connected in a cascade fashion, as shown in FIG. 9B. To realize the cascade connection of scanning electrode driving circuits, the code generator 221 is adapted to operate in different modes depending on whether the Y driver is at the first stage of Y driver 1 or the second or following stages of Y drivers 2–n, wherein the mode is switched in response to a signal given to a select terminal MS. More specifically, the Y driver 1 at the first stage operates as follows. That is, after initialization in response to the frame start pulse YD, the code generator 221 starts to generate voltage selection codes to the two shift registers 223 and 224. In contrast, in the Y drivers at the second and following stages, the select terminal MS of the code generator 221 is fixed at a low level so that the code generator does not automatically start generating voltage selection codes. The Y drivers 2–n at the second and following stages start generating voltage selection codes to the two shift registers 223 and 224 only when a carry signal (FS) from the first stage is input from the FSI input terminal. When a carry signal (FS) is output from the Y driver n at the final stage, the first field is completed. At this time, the controller generates no start signal for starting a second field. Instead, the carry signal (FS) generated by the Y driver n at the final stage is fed back to the FSI terminal of the Y driver 1 at the first stage and also to the FS terminal of the X driver thereby starting generating voltage selection codes associated with the second field to the two shift registers 223 and 224. After that, the operation is continued in a manner similar to that for the first field. In this way, the operation is performed successively for the second, third, and the fourth fields. If the operation for the fourth field is completed, the operation for the next field (first field) is started. The above-described capability makes it possible to reduce the difficulty resulting from the limitation in the number of lines which can be selected at the same time and limitation in the number of terminals of the Y driver, and thus, it makes it possible for the driver circuit to operate in response to the frame start pulse YD and the latch pulse LP supplied at the same frequency as in the conventional voltage averaging method.

Example of Construction of Signal Electrode Driving Circuit

Figure 11:
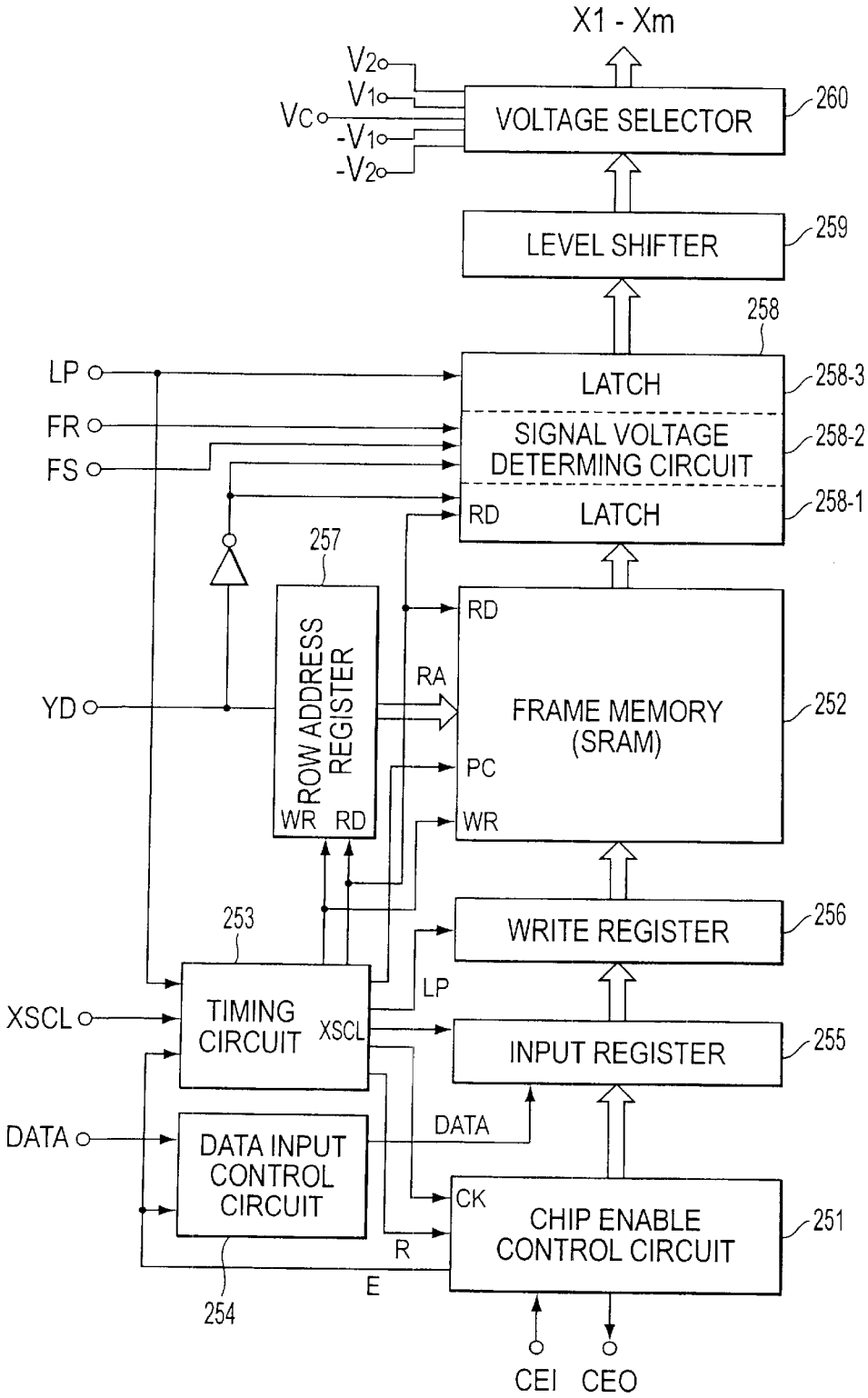
FIG. 11 is a block diagram illustrating a signal electrode driving circuit (X driver) of a liquid crystal display device according to the present invention.

The construction of the signal electrode driving circuit (X driver) is described below. The X driver is a semiconductor integrated circuit constructed as shown in FIG. 11. A plurality of X drivers may be connected in a cascade fashion via chip enable outputs CEO and chip enable inputs CEI. As shown in FIG. 11, the X driver includes: a chip enable control circuit 251 serving as an automatic power saving circuit which operates in response to an active-low signal; a timing circuit 253 for generating a required timing signal on the basis of a signal supplied mainly from a control circuit (not shown); an input register 255 which sequentially stores, in response to a high-to-low transition of a shift clock XSCL, one scanning line of display data DATA (1-bit, 4-bit, or 8-bit data) which is transferred from the control circuit in response to an enable signal E; a write register 256 which latches, in response to a high-to-low transition of the latch pulse LP, one scanning line of display data DATA supplied from the input register 255 and then writes the latched data into a memory matrix of a frame memory (SRAM) 252 during a writing time period equal to or longer than one shift clock XSCL; a row address register 257 which is initialized by the scanning start signal YD and which sequentially selects a row (word line) of the frame memory 252 in response to a write control signal WR or a read control signal RD; a signal voltage determining circuit 258 which determines driving voltage information associated with the signal electrodes on the basis of the display data supplied from the frame memory 252 and the voltage selection pattern of the scanning electrodes; a level shifter 259 which converts the low logic swing signal supplied from the signal voltage determining circuit 258 to a high logic swing signal; and a voltage selector 260 which selects one of five voltage levels V2, V1, Vc (0V), −V1, and −V2, which will be described later with reference to FIG. 8, in accordance with the voltage selection code signal with the high logic swing supplied from the level shifter 259, and applies the selected voltage to respective signal electrodes X1–Xn.

Figure 12:
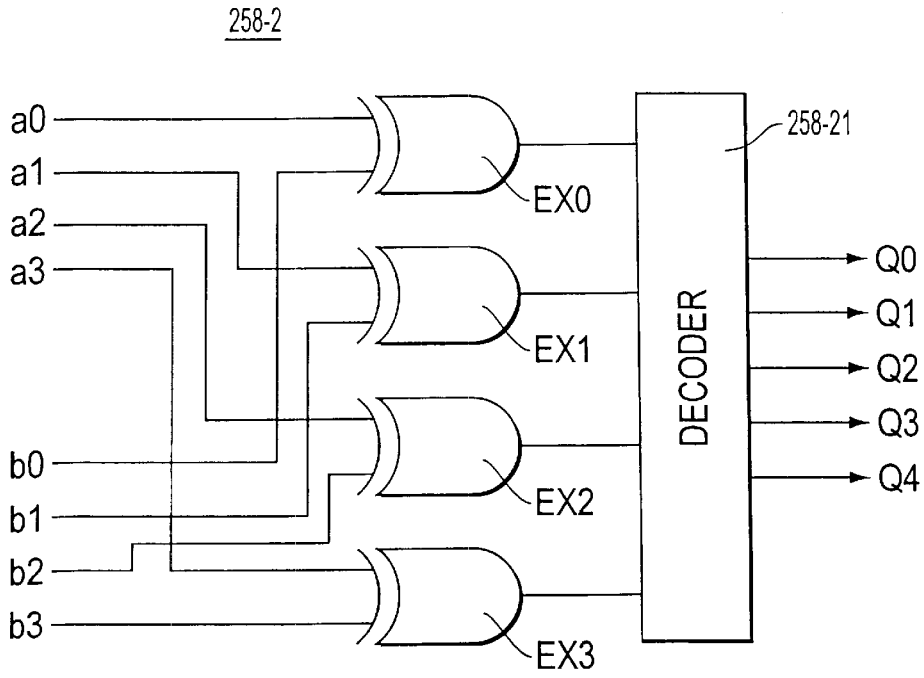
FIG. 12 is a circuit diagram of a circuit for detecting the number of non-coincident levels used in the signal electrode driving circuit (X driver) according to the present invention.

The signal voltage determining circuit 258 includes a latch circuit 258-1, a circuit 258-2 for detecting the number of non-coincident signals, and a latch circuit 258-3. FIG. 12 is a block diagram illustrating the circuit 258-2 for detecting the number of non-coincident signals. The circuit 258-2 for detecting the number of non-coincident signals includes exclusive OR gates EX0, EX1, EX2, and EX3, wherein non-coincidence data a0, b0, a1, b1, a2, b2, a3, b3 are input to the respective exclusive OR gates. The outputs of the exclusive OR gates EX0, EX1, EX2, and EX3 are input to a decoder 258-21, which in turn, generates selection control signals Q0, Q1, Q2, Q3, and Q4.

Figure 13:
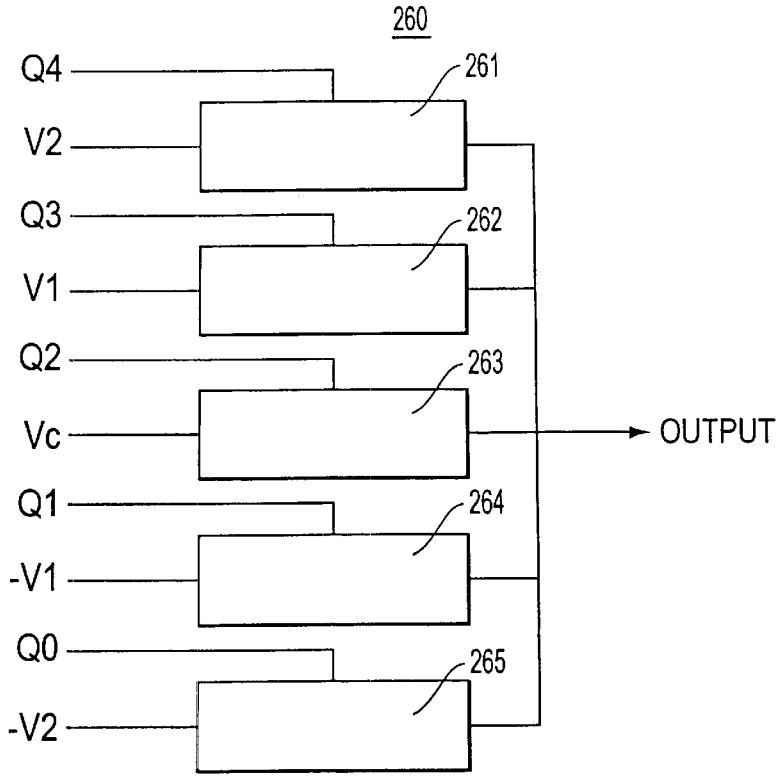
FIG. 13 is a block diagram illustrating a voltage selector used in a signal electrode driving circuit (X driver) according to the present invention.

FIG. 13 is a block diagram illustrating the voltage selector 260. The selection signals Q0, Q1, Q2, Q3, and Q4 generated by the circuit 258-2 for detecting the number of non-coincident signals are input to the voltage selector 260 via the latch circuit 258-3 and the level shifter 259. The voltage selector 260 includes analog switches 261, 262, 263, 264, and 265 wherein voltages V2, V1, Vc, −V1, and −V2 are sequentially supplied to the respective analog switches. A selection control signal Q4 is input to the analog switch 261, a selection control signal Q3 to the analog switch 262, a selection control signal Q2 to the analog switch 263, a selection control signal Q1 to the analog switch 264, and a selection control signal Q0 to the analog switch 265. Voltages of 5 levels are alternatively selected by these analog switches.

Example of the Construction of the Power Supply Circuit

Figure 16:
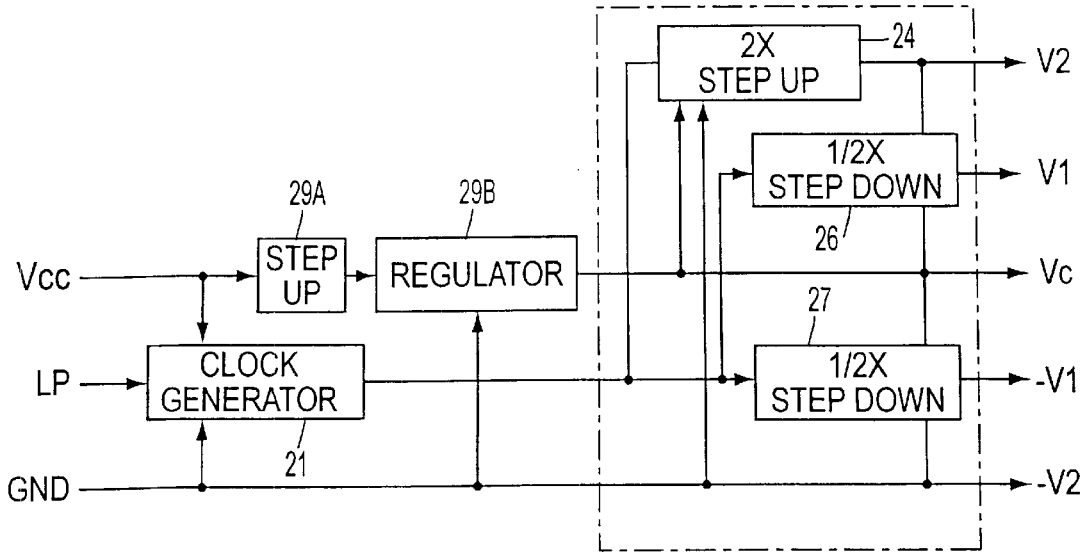
FIG. 16 is a block diagram illustrating a power supply circuit according to the present invention.

Referring now to FIG. 16, the power supply circuit for supplying a five-level voltage to the signal electrode driving circuit and the scanning electrode driving circuit is described below.

Vcc (first input potential) and GND (second input potential) are supplied to the power supply circuit. That is, a single voltage is input to the power supply circuit. The power supply circuit also receives a latch pulse LP generated every horizontal scanning period. In response to the latch pulse LP, a clock generator 21 generates a plurality of clock signals with different timing used by charge pump circuits. In the above operation, GND is employed as −V2, and the other voltage levels are created with respect to −V2 using Vcc and GND as a power supply. In this power supply circuit, unlike the power supply circuit shown in FIG. 1 in which Vc=0 V, the respective driving voltages are generated such that they become positive with respect to GND (0 V). In either case, an equal root-means-square voltage is applied across the liquid crystal of the liquid crystal display device. However, the power supply circuit can be constructed in a simpler fashion if all driving voltages generated are positive.

As shown in FIG. 16, a voltage boosting circuit 29A and a regulator 29B are connected to Vcc. A twofold boosting circuit 24 multiplies Vc with respect to GND by 2 by a charge pumping operation, thereby generating a positive selection voltage V2. ½ dropping circuits 26 and 27 generate V1 by equally dividing by equally dividing between Vc and V2, and also generate −V1 by equally dividing between GND and Vc by a charge pumping operation.

Figure 15:
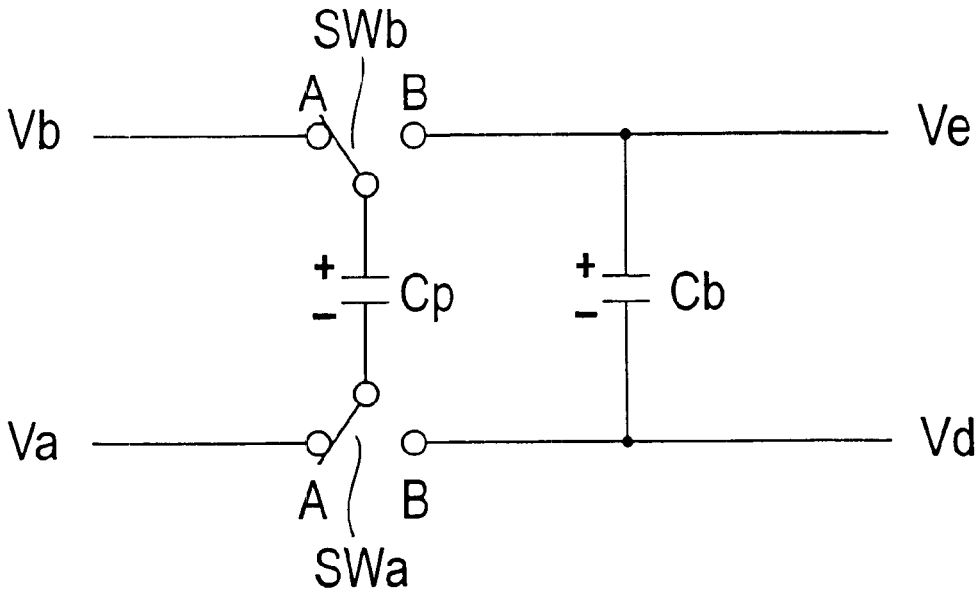
FIG. 15 is a circuit diagram illustrating the charge pumping operation of a power supply circuit according to the present invention.

FIG. 15 conceptually illustrates the basics of a charge pump circuit. In FIG. 15, switches SWa and SWb are interlocked with each other such that when one of these switches is in a position A the other switch is in the position A. Although the switches SWa and SWb shown in FIG. 15 are of the mechanical type, each switch may be constructed, in practice, using two MOS transistors, one of which serves to control a conduction/shutdown to the side A, and the other serves to control a conduction/shutdown to the side B.

When the switches SWa and SWb are in the position A, a pumping capacitor Cp is charged by a voltage Vb−Va. If the switches SWa and SWb are turned to the side B, the charge stored in the capacitor Cp is transferred to a backup capacitor Cb. As the switching operation described above is performed repeatedly, the voltage across the capacitor Cb, that is the voltage Ve−Vd, approaches a value equal to Vb−Va. If Vd is fixed to a particular voltage, voltage Ve becomes higher than Vd by a value equal to Vb−Va. Conversely, in the case where Ve is fixed to a particular voltage, voltage Vd becomes lower than Ve by a value equal to Vb−Va. The charge pump circuit basically operates in the above-described manner. The charge pump circuit shown in FIG. 15 can serve as either a voltage boosting circuit or a voltage dropping circuit depending on the where Va, Vb, Vd and Ve are connected.

Figure 14:
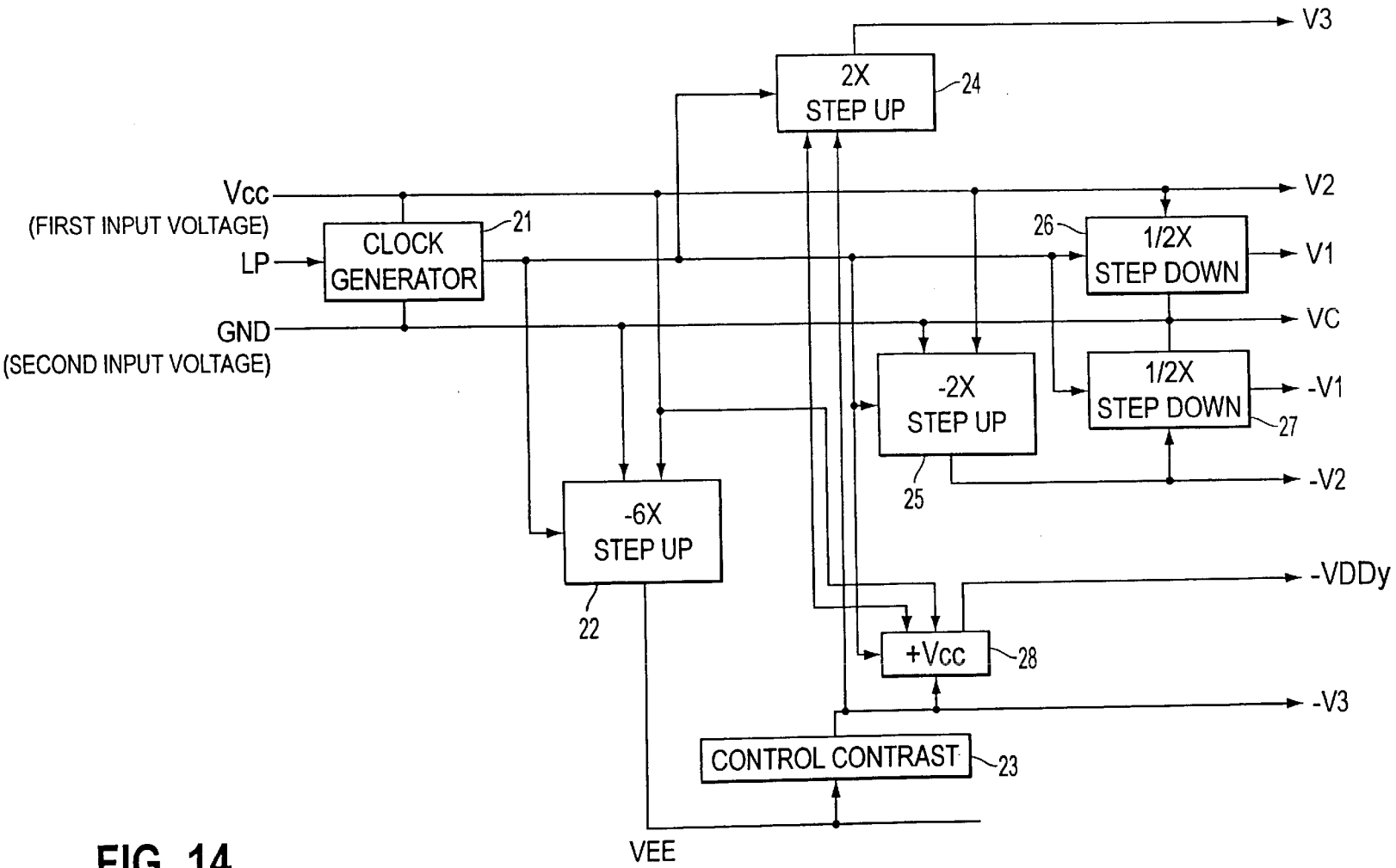
FIG. 14 (RELATED ART)
FIG. 14 is a block diagram illustrating a conventional power supply circuit used to drive a liquid crystal display device.

Compared with the conventional power supply circuit shown in FIG. 14, the present power supply circuit has the advantage that the number of capacitors used in the part surrounded by the dash-dot line can be reduced from 13 to 6, and thus the circuit configuration is simplified.

Modification of the Power Supply Circuit

Figure 17:
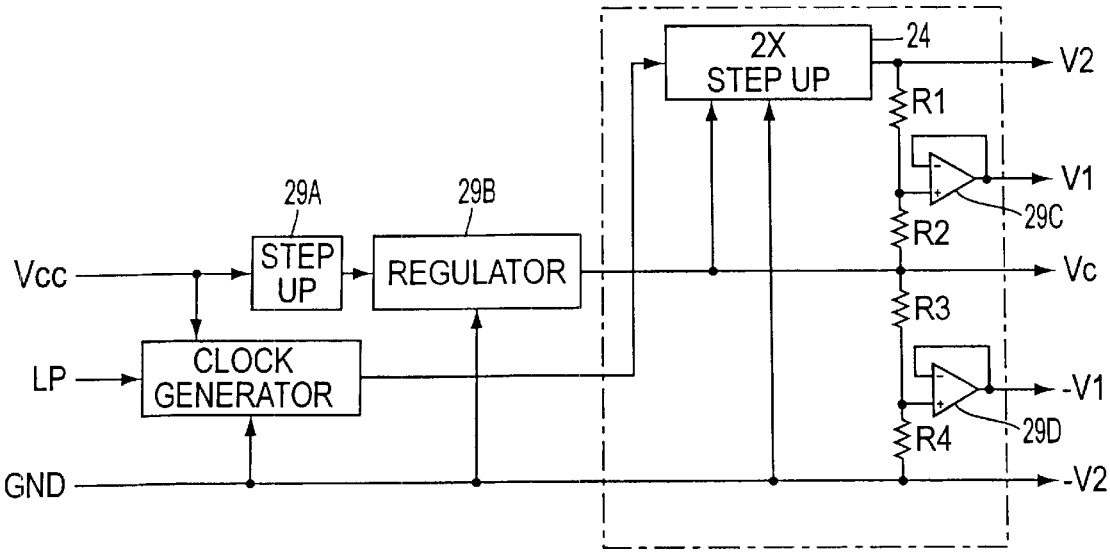
FIG. 17 is a block diagram illustrating a modification of the power supply circuit according to the present invention.

FIG. 17 is a block diagram illustrating an example of a modified power supply circuit. This power supply circuit can be obtained by modifying the power supply circuit shown in FIG. 16 such that the ½ dropping circuit 26 is replaced with voltage dropping means comprising resistors R1, R2 and a gate 29C and the ½ dropping circuit 27 is replaced with voltage dropping means comprising resistors R3, R4 and a gate 29D. In this power supply circuit, the part surrounded by the dash-dot line needs only two capacitors, and thus, the circuit configuration is further simplified.

Figure 3:
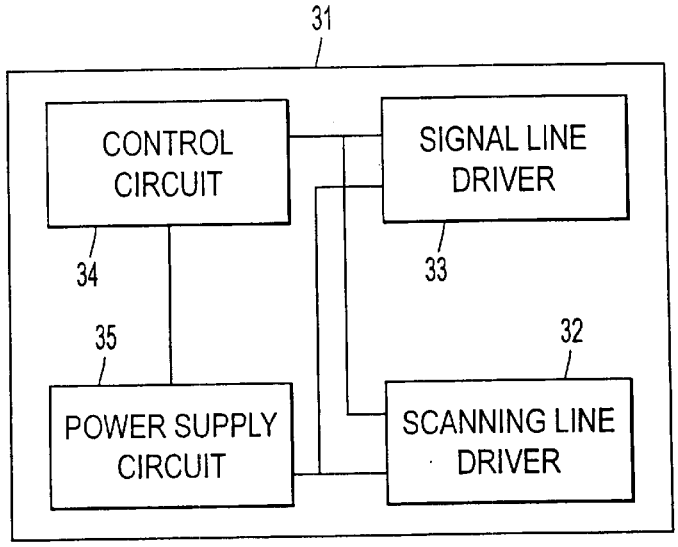
FIG. 3 is a block diagram illustrating an example of a driving circuit according to the present invention.

The driving method described above allows the scanning electrode driving circuit to have a driving voltage amplitude equal to that of the signal electrode driving circuit. This makes it possible to integrate at least both of the scanning electrode driving circuit (scanning line driver 32 and the signal electrode driving circuit (signal line driver) 33 on a single-chip IC 31, as shown in FIG. 3. In addition to the scanning electrode driving circuit 32 and the signal electrode driving circuit 33, it may be possible to further integrate other circuits such as a control circuit 34, a power supply circuit 35 having the construction described above, and the like.

Thus, it is possible to achieve enhancement in contrast and a reduction in the driving voltage. Furthermore, the number of levels associated with the driving voltage can be reduced. As a result, it becomes possible to reduce the total electric power consumed by the power supply circuit, the driving circuits, the liquid crystal panel, and the like, of the liquid crystal display device. Furthermore, the power supply circuit and the driving circuits can be constructed in simpler fashions. Even when there are as many as 12 scanning lines, it is possible to drive the scanning lines using a driver integrated circuit having a breakdown voltage as low as 10 V or lower. This allows a reduction in cost. Still furthermore, as shown in FIG. 3, it becomes possible to combine the power supply circuit, the control circuit, the signal electrode driving circuit, the scanning electrode driving circuit, and the like, in an integral fashion on a single chip, which results in a reduction in the total size.

Although the selection periods are distributed into four parts in the first embodiment, the selection periods may be distributed into two parts every 2H periods or may be distributed in another fashion, for example, as disclosed in Japanese Unexamined Patent Publication No. 9-15556.

The techniques associated with the scanning electrode driving circuit, the signal electrode driving circuit, and the power supply circuit may be used in other embodiments which will be described later.

Second Embodiment

A liquid crystal display device according to a second embodiment is described below. This liquid crystal display device has a construction similar to that employed in the first embodiment. That is, as shown in the block diagram of FIG. 5, the liquid crystal display device includes scanning electrodes 54 and signal electrodes 53. An STN (super twisted nematic) liquid crystal whose molecules are aligned at a twist angle equal to or greater than 180° is disposed between the scanning electrodes 54 and the signal electrodes 53. Herein, as in the first embodiment, it is also assumed that the liquid crystal display device is of the reflective type in which the image becomes black when a voltage is applied to the liquid crystal.

Figure 2:
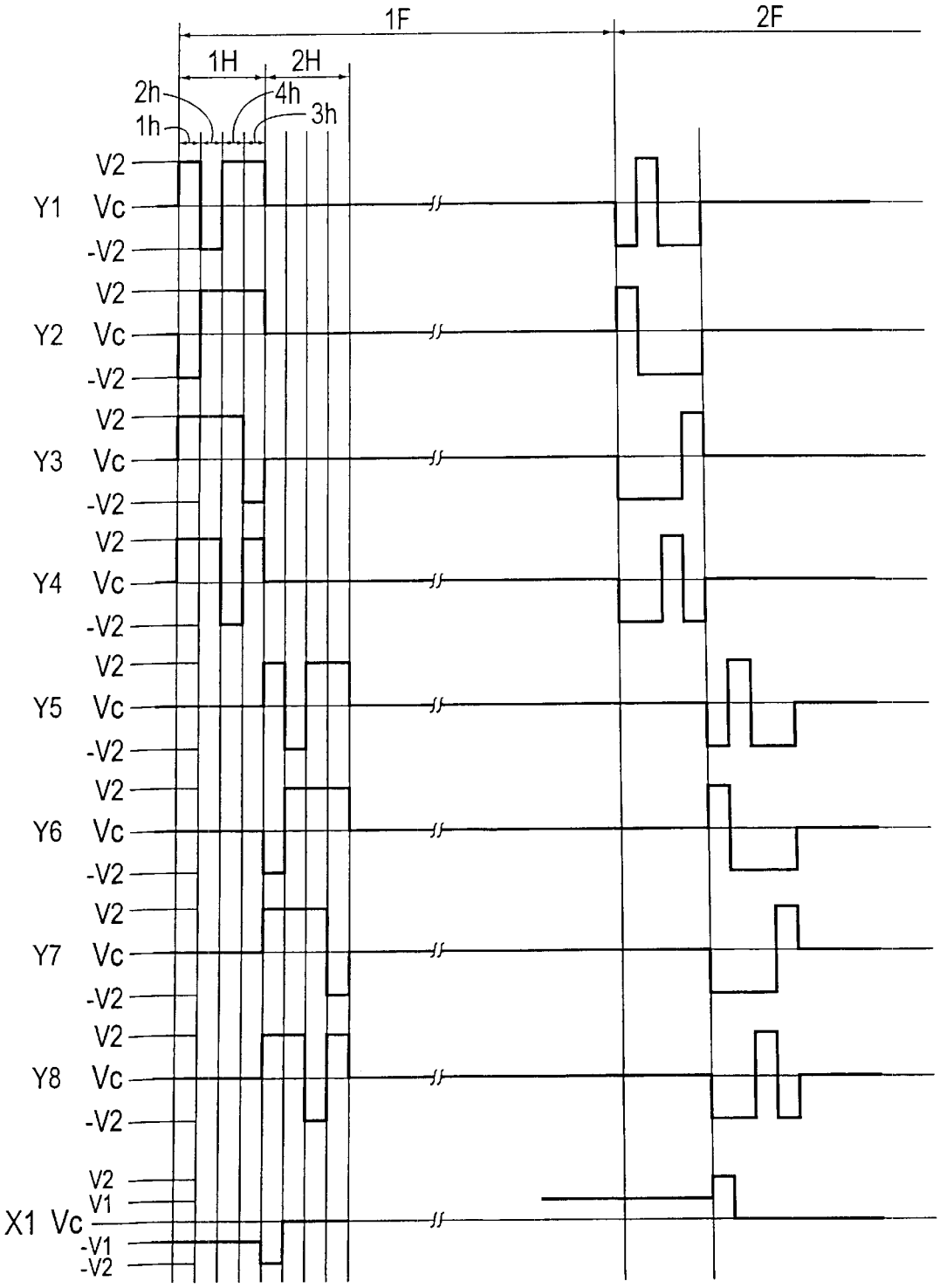
FIG. 2 is a wave-form chart illustrating an example of a method of driving a liquid crystal display device according to a second embodiment of the present invention.

FIG. 2 illustrates driving waveforms employed in the present embodiment. In the driving method according to the present embodiment, scanning electrodes (lines) are sequentially selected group by group such that four scanning electrodes (four lines) are selected at a time. As in the first embodiment, selection voltages are applied at the same time to the scanning electrodes simultaneously selected, in accordance with an normal orthogonal matrix such that the signal polarity of the selection voltages are orthogonal to each other during a particular period. However, in this second embodiment, unlike the first embodiment in which selection periods (H) are distributed over one frame period (1F), four selection voltages 1h–4h which are applied during one frame period in the first embodiment are combined together to constitute one selection period (H). Y1 to Y8 denote scanning voltage waveforms applied to the respective scanning electrodes 54 denoted by Y1 to Y8 of the liquid crystal display device shown in the form of a block diagram in FIG. 5. X1 denotes the waveform of a signal voltage applied to a signal electrode 53 denoted by X1 in FIG. 5.

Figure 6:
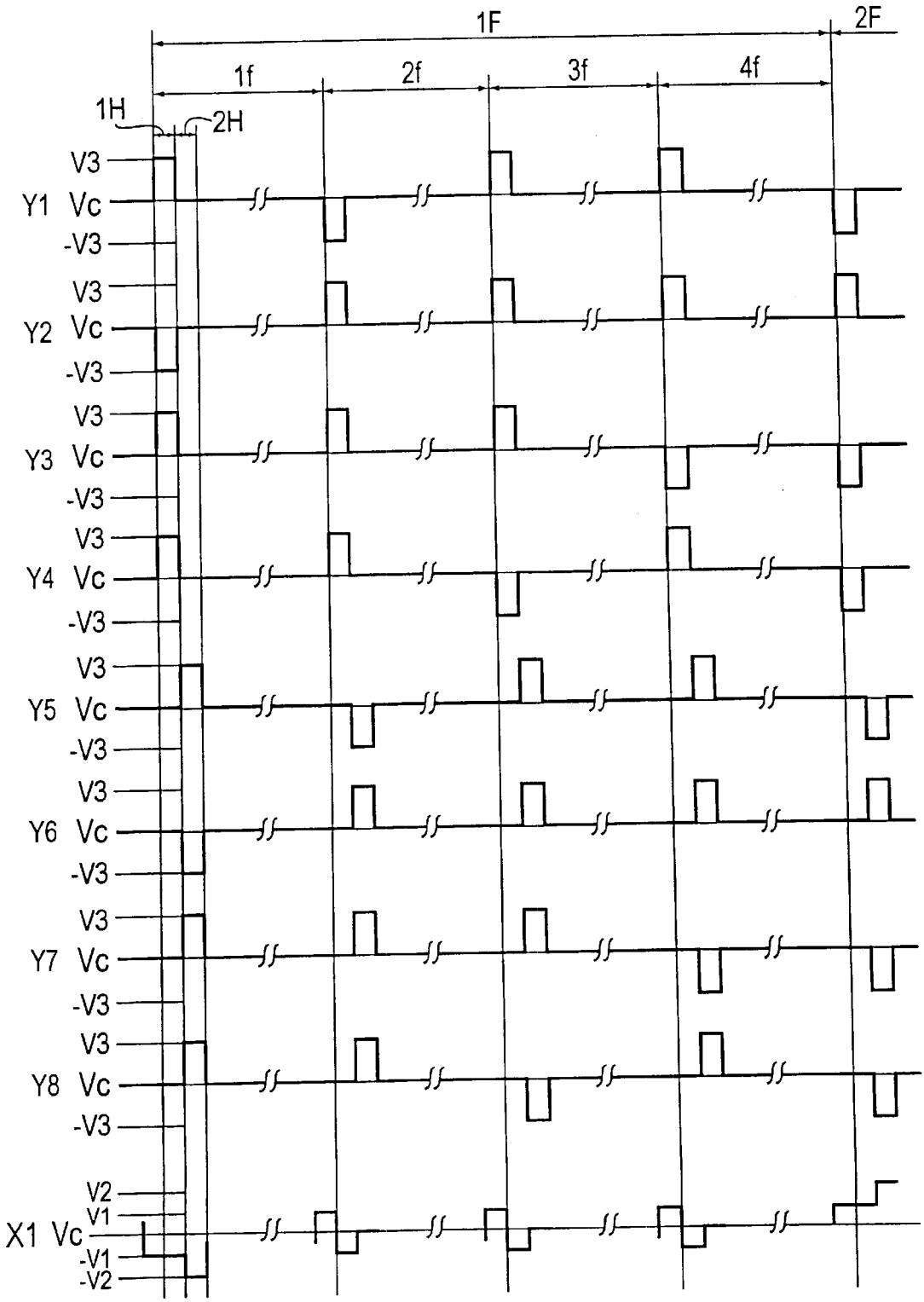
FIG. 6 (RELATED ART)
FIG. 6 is a wave-form chart illustrating a conventional method of driving a liquid crystal display device.

In the driving method according to the present invention, as shown in FIG. 2, the amplitude of the scanning voltage waveform associated with the selection voltage is set to be equal to the amplitude of the signal voltage waveform. More specifically, with respect to Vc (0 V for example), the positive selection voltage level V2 of the scanning voltage waveform is set to be equal to the positive voltage level V2 of the signal voltage waveform, and the negative selection voltage level −V2 of the scanning voltage waveform is set to be equal to the negative voltage level −V2 of the signal voltage waveform. This allows a reduction in the number of voltage levels associated with the driving voltages to five levels from the seven levels as shown in FIG. 6.

The characteristics of the liquid crystal used are described below. FIG. 4 illustrates an optical characteristic of the liquid crystal. More specifically, the luminance is shown as a function of the root-means-square voltage applied to the liquid crystal. Vt1 and Vt2 denote voltages (threshold voltages) at which a bright-to-dark transition occurs in the pixels of the liquid crystal display device when the root-means-square voltage applied to the liquid crystal is changed. Vs1 and Vs2 denote voltages (saturation voltages) at which the pixels of the liquid crystal display device reach an ultimately dark state after gradually becoming dark in response to the increase in the root-means-square voltage applied to the liquid crystal. The liquid crystal 1 has a lower threshold voltage and the liquid crystal 2 has a higher threshold voltage.

Of two types of liquid crystals described above, the liquid crystal of type 2 is employed in the present invention. The liquid crystal of this type has a relatively high threshold voltage Vt2 and has a relatively low ratio of Vs2 to Vt2. Therefore, this liquid crystal can be driven while maintaining high contrast even when there are a large number of scanning electrodes. More specifically, the liquid crystal 2 has a threshold voltage Vt2 of about 2.2 V and a saturation voltage Vs2 of about 2.31 V, and thus, the ratio of Vs2 to Vt2 becomes 1.05.

In the present embodiment, by applying the above-described driving method to the liquid crystal of type 2, it becomes possible to realize a high-contrast liquid crystal display device which can be driven by a low driving voltage, as will be described in further detail below.

For example, when there are 64 scanning electrodes, the voltages applied to the liquid crystal according to the above-described driving method become such that V2 is about 4.1 V and V1 is about 2.05 V, if Vc=0. In this case, the ratio of the root-means-square value of on-voltage to the root-means-square value of off-voltage applied to the liquid crystal becomes about 1.105, and thus, Vs2/Vt2= 1.05<1.105. This ensures that high enough contrast can be achieved.

In the case where there are 120 scanning electrodes, the voltages applied to the liquid crystal according to the driving method of the present invention become such that V2 is about 4.4 V and V1 is about 2.2 V if Vc=0. In this case, the ratio of the root-means-square value of on-voltage to the root-means-square value of off-voltage applied to the liquid crystal becomes about 1.06, and thus, Vs2/Vt2=1.05<1.06. Therefore, also in this case, high enough contrast can be achieved.

The driving method described above allows the scanning electrode driving circuit to have a scanning voltage amplitude equal to the amplitude of the signal voltage output from the signal electrode driving circuit. This makes it possible to integrate at least both of the scanning electrode driving circuit (scanning line driver) 32 and the signal electrode driving circuit (signal line driver) 33 on a single-chip IC 31 as shown in FIG. 3. In addition to the scanning electrode driving circuit 32 and the signal electrode driving circuit 33, it may be possible to further integrate other circuits such as a control circuit 34, a power supply circuit 35 having the construction described above, and the like.

Thus, it is possible to achieve enhancement in contrast and a reduction in the driving voltage. Furthermore, the number of levels associated with the driving voltage can be reduced. As a result, it becomes possible to reduce the total electric power consumed by the power supply circuit, the driving circuits, the liquid crystal panel, and the like, of the liquid crystal display device. Furthermore, the power supply circuit and the driving circuits can be constructed in simpler fashions. Even when there are as many as 120 scanning lines, it is possible to drive the scanning lines using a driver integrated circuit having a breakdown voltage as low as 10 V or lower. This allows a reduction in cost. Still furthermore, as shown in FIG. 3, it becomes possible to combine the power supply circuit, the control circuit, the signal electrode driving circuit, the scanning electrode driving circuit, and the like on a single chip in an integral fashion which results in a reduction in the total size.

Third Embodiment

Figure 7:
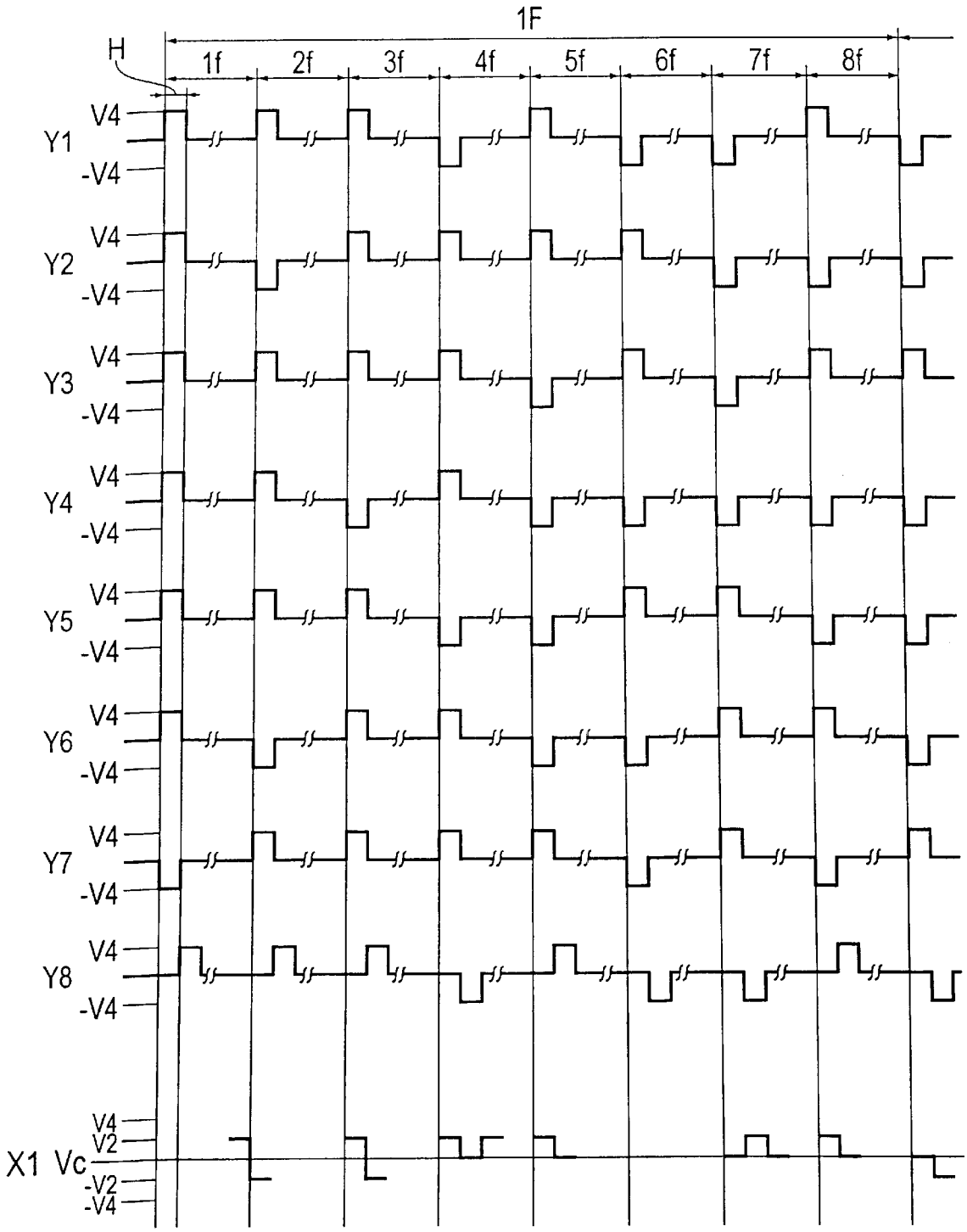
FIG. 7 is a wave-form chart illustrating a method of driving a liquid crystal display device according to a third embodiment of the present invention.

FIG. 7 illustrates driving waveforms employed in this third embodiment. In the driving method according to the present embodiment, scanning electrodes (lines) are sequentially selected on a group-by-group basis such that seven scanning lines are selected at a time. As in the first embodiment, selection voltages are applied to the scanning electrodes simultaneously selected, in accordance with a normal orthogonal matrix such that the signal polarity of the selection voltages are orthogonal to each other during a particular period. In this third embodiment, as in the first embodiment, selection periods (H) are distributed over one frame period (1F). In this embodiment, the liquid crystal display device has a similar construction to that shown in the block diagram of FIG. 5, and thus a description is given below with reference to FIG. 5.

A substrate having scanning electrodes 54 (Y1–Yn) formed on the inner surface thereof and a substrate having signal electrodes 53 (X1–Xn) formed on the inner surface thereof are disposed such that they oppose each other. An STN (super twisted nematic) liquid crystal whose molecules are aligned at a twist angle equal to or greater than 180° is disposed between the pair of substrates described above. In this liquid crystal device, polarizers are disposed outside the pair of substrates such that one polarizer is located on one side and the other polarizer is located on the opposite side. A retardation film is disposed at least between either one of the polarizer and the corresponding substrate. In the present embodiment, the liquid crystal display device is, by way of example, of the reflective type having a reflector disposed on the outer surface of the polarizer located opposite the viewing side, wherein the image becomes black when a voltage is applied to the liquid crystal. In FIG. 5, a scanning line driver (also called a scanning electrode driving circuit or Y driver) 52 applies a scanning voltage waveform, which will be described later, to the scanning electrodes 54, and a signal line driver (also called a signal electrode driving circuit or X driver) 51 applies a signal voltage waveform, which will be described later, to the signal electrodes 53. Pixels are arranged in a matrix at respective intersections of the scanning electrodes 54 and the signal electrodes 53. The difference between the scanning voltage waveform and the signal voltage waveform is applied as a root-means-square voltage across the liquid crystal at the pixels. If a root-means-square voltage greater than the threshold voltage of the liquid crystal is applied, the corresponding pixel goes into an on-state (black state). Conversely, when the applied root-means-square voltage is lower than the threshold voltage, the corresponding pixel is in an off-state (white state, or a state representing a particular color assigned to the pixel in the case of a color display device). The liquid crystal display device may also be of a transmissive type in which pixels go into an off-state when a root-means-square voltage higher than the threshold voltage of the liquid crystal is applied, and pixels are in an on-state when the applied root-means-square voltage is lower than the threshold voltage.

In the driving method shown in FIG. 7, scanning electrodes are sequentially selected group by group (by means of multi-line selection), wherein seven scanning electrodes (seven lines) are selected at a time. This method allows a reduction in the number of levels associated with the voltage applied to the signal electrodes to five levels from the nine levels which are required when the conventional driving method is employed.

In general, the number of voltage levels required in the driving method in which a plurality of scanning electrodes are selected at a time can be reduced as follows.

The number of scanning electrodes which are simultaneously selected is set to h such that the h scanning electrodes contain e virtual scanning electrodes (virtual lines). Coincidence/non-coincidence in terms of signal levels between the display data displayed by the pixels of the virtual scanning electrodes and the voltage selection pattern (signal polarity pattern of selection voltages) applied to the scanning electrodes is controlled so that the total coincidence/non-coincidence becomes consistent thereby reducing the number of levels associated with signal voltages applied to the signal electrodes. If the number of non-coincident signals is denoted by Mi, then the voltage $V_{column}$ applied to the signal electrodes can be given by the following equation:

$$V_{column} = Vc\sum_{j=1}^{h} a_{k*h+1} \oplus d_{k*h+1}$$

$$= Vc(2Mi - h)$$

where Vc is a constant.

The above expression may be given in a simpler form as follows:

$$V_{column} = V(i) \qquad 0 \leqq i \leqq h$$

In any event, $V_{column}$ takes h+1 levels.

In the present embodiment, h associated with each subgroup is equal to eight, and thus, eight scanning electrodes are selected at the same time. If no reduction is made in the number of voltage levels, then nine levels such as −V4, −V3, −V2, −V1, 0, V1, V2, V3, and V4 are required. Instead, grouping associated with scanning electrodes may be performed such that one virtual scanning electrode is contained in each group consisting of eight scanning electrodes so that seven scanning electrodes are actually selected at the same time, and the signal applied to the virtual scanning electrode is controlled so that the total number of non-coincident signals becomes even, as illustrated in TABLE 1.

TABLE 1

| ORIGINAL VOLTAGE LEVEL | ORIGINAL NUMBER OF NON-COINCIDENT SIGNALS | COINCIDENCE OF VIRTUAL SCANNING ELECTRODE | CORRECTED NUMBER OF NON-COINCIDENT SIGNALS | CORRECTED VOLTAGE LEVEL |
|---|---|---|---|---|
| −V4 | 0 | YES | 0 | Va |
| −V3 | 1 | NO | 2 | Vb |
| −V2 | 2 | YES | 2 | Vb |
| −V1 | 3 | NO | 4 | Vc |
| 0 | 4 | YES | 4 | Vc |
| V1 | 5 | NO | 6 | Vd |
| V2 | 6 | YES | 6 | Vd |
| V3 | 7 | NO | 8 | Ve |
| V4 | 8 | YES | 8 | Ve |

Figure 8:
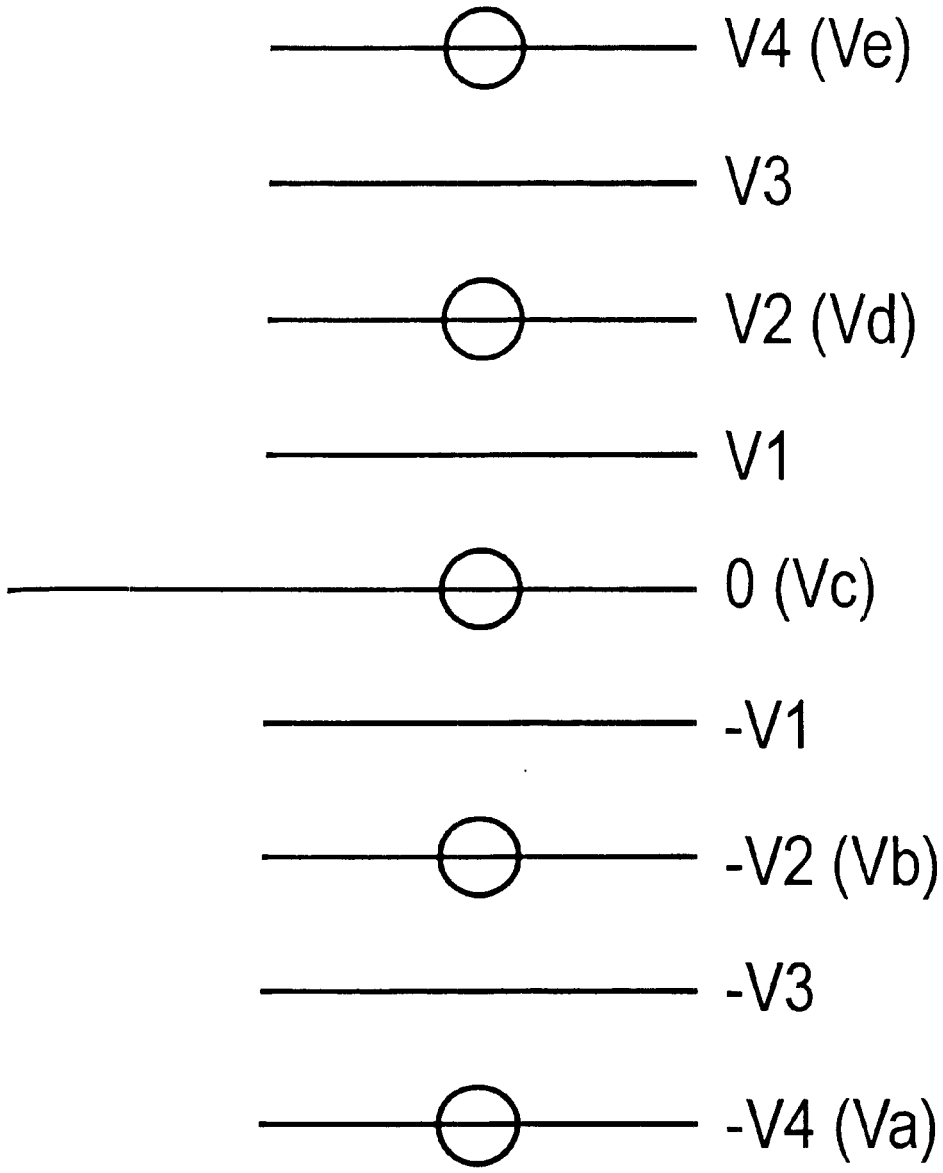
FIG. 8 is a schematic representation of voltage levels employed in the driving method according to the third embodiment of the present invention.

As can be seen from TABLE 1, it is possible to reduce the number of voltage levels to five from the original number of nine. FIG. 8 illustrates an example in which, of the original nine levels −V4, −V3, −V2, −V1, 0, V1, V2, V3, and V4, odd-numbered voltage levels are employed as voltages Va, Vb, Vc, Vd, and Ve applied to the signal electrodes.

The virtual scanning electrode is not necessarily needed to be used to display an image, and thus, it is not necessarily required to actually form the virtual scanning electrode. However, in the case where the virtual scanning electrode is actually formed, it may be disposed in an area which does not influence the image actually displayed.

As described above, selection voltages are applied to scanning electrodes selected at the same time, in accordance with an normal orthogonal matrix such that the signal polarity of the selection voltages are orthogonal to each other during a particular period. In the driving method shown in FIG. 7, selection periods (H), during each of which one line is selected, are periodically distributed over one frame period (1F) so that each line is selected once in each of eight fields 1f–8f constituting one frame. Although eight lines of scanning electrodes are selected at a time, selection voltages are applied to seven lines at the same time because one of the eight lines is a virtual scanning electrode. In this case, one frame consists of eight fields and each scanning electrode is selected eight times during one frame. Y1–Y8 denote scanning voltage waveforms which are applied to the respective scanning electrodes Y1–Y8 of the liquid crystal display device shown in FIG. 5 in the form of a block diagram. X1 denotes a signal voltage waveform which is applied to the signal electrode denoted by X1 in FIG. 5 to display an image along the signal electrode X1 as shown in FIG. 5.

In the present embodiment, as in the first and second embodiments described above, the amplitude of the scanning voltage waveform associated with the selection voltage is set to be equal to the amplitude of the signal voltage waveform. More specifically, with respect to Vc (0 V for example), the positive selection voltage level V4 of the scanning voltage waveform is set to be equal to the positive voltage level V4 of the signal voltage waveform, and the negative selection voltage level −V4 of the scanning voltage waveform is set to be equal to the negative voltage level −V4 of the signal voltage waveform. This allows a reduction is in the number of voltage levels associated with the driving voltages to five levels from the eleven levels (equal to the number of levels associated with the selection voltage plus the number of levels associated with the signal voltage) which are required when the conventional driving method is employed.

In the present embodiment, a liquid crystal of type 2 shown in FIG. 4 is employed. Although the liquid crystal of type 2 has a relatively high threshold voltage Vt2, the ratio of Vs2 to Vt2 is rather low, and thus, it is possible to drive the liquid crystal while maintaining high contrast even when there are a large number of scanning lines. More specifically, the liquid crystal 2 has a threshold voltage Vt2 of about 2.2 V and a saturation voltage Vs2 of about 2.31 V and thus (Vs2/Vt2)=1.05. In the present embodiment, by applying the above-described driving method to the liquid crystal of type 2, it becomes possible to realize a high-contrast liquid crystal display device which needs a low driving voltage, as will be described in further detail below.

For example, when there are 203 scanning electrodes, the voltages applied to the liquid crystal according to the driving method of the present invention become such that Vc=0V, Vth=2.2 V, V4 is about 5.66 V, Vth=1.7 V, and V4 is about 4.37 V. In this case, the ratio of the root-means-square value of on-voltage to the root-means-square value of off-voltage applied to the liquid crystal becomes about 1.056, and thus (Vs2/Vt2)=1.05<1.056. This ensures that high enough contrast can be achieved.

The driving method described above allows the scanning electrode driving circuit to have a driving voltage amplitude equal to that of the signal electrode driving circuit. This makes it possible to integrate at least both of the scanning electrode driving circuit (scanning line driver) 32 and the signal electrode driving circuit (signal line driver) 33 on a single-chip IC 31, as shown in FIG. 3. In addition to the scanning electrode driving circuit 32 and the signal electrode driving circuit 33, it may be possible to further integrate other circuits such as a control circuit 34, a power supply circuit 35 having the construction described above, and the like.

Figure 18:
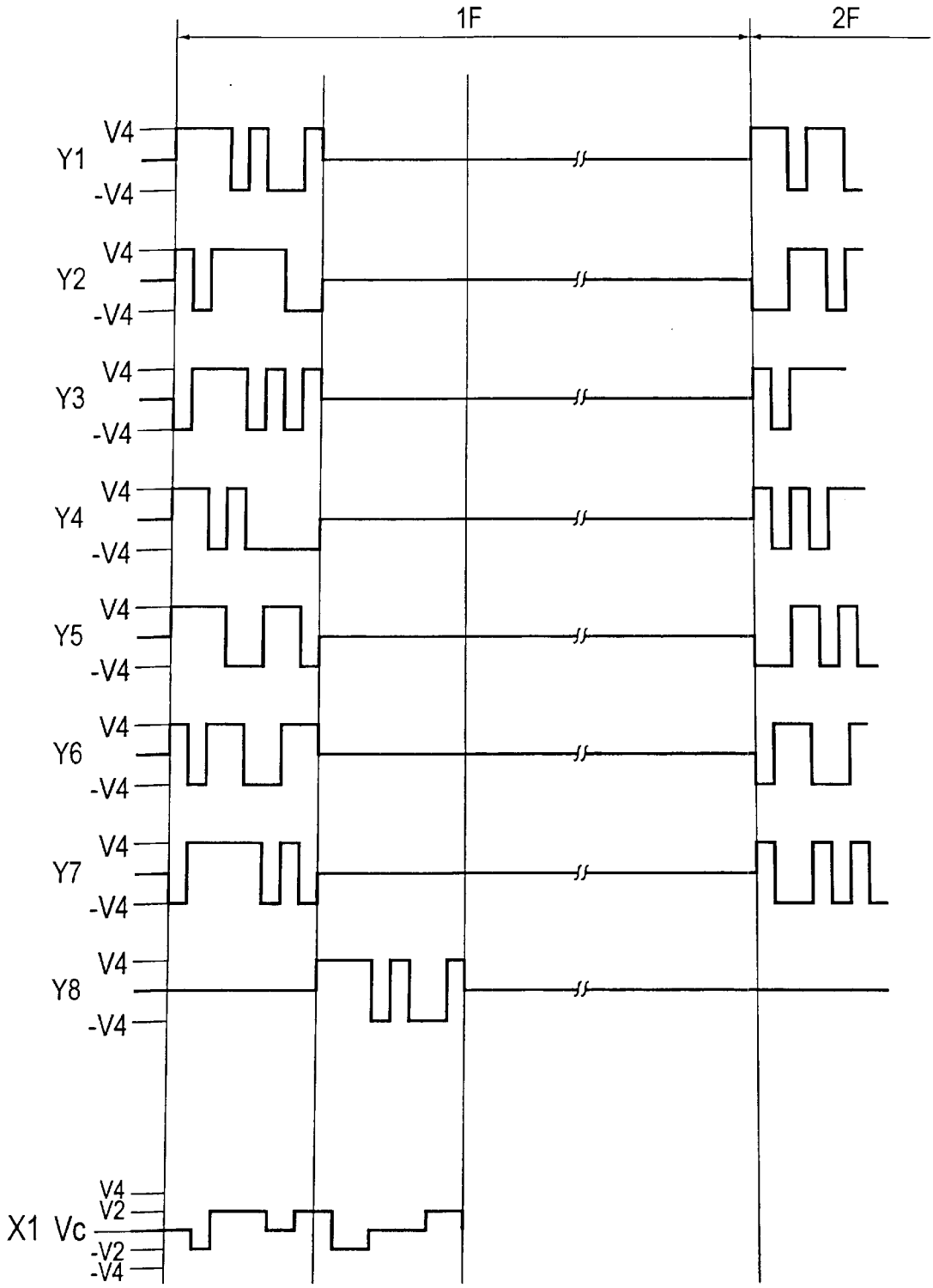
FIG. 18 is a wave-form chart illustrating a modification of the driving method according to the third embodiment.

In the present embodiment, selection pulses for simultaneously selecting seven lines are distributed over eight fields. Alternatively, a driving method of non-distribution during the selection period for performing simultaneous selection and sequential selection can be employed in which, instead of distributing selection pulses, seven lines of scanning electrodes which are simultaneously selected during a predetermined period may be continuously selected, as shown in FIG. 18. That is, a selection period is set such that the same scanning electrode is continuously selected during period 1F, and after the end of the selection period during which a set of seven lines is continuously selected, another set of seven lines are selected.

In the present embodiment, because seven lines are selected at a time, the signal electrode driving circuit generates signal electrode potentials for each horizontal period in accordance with display data over 7 lines and a determinant of voltage selection column pattern of the scanning electrode.

Although in the present embodiment, voltage levels V4, V2, VC, −V2, and −V4 are selected as shown in FIG. 8, V3, V1, VC, −V1, and −V3 may also be selected.

Thus, in the present embodiment, it is possible to achieve enhancement in contrast and a reduction in the driving voltage. Furthermore, the number of levels associated with the driving voltage can be reduced. As a result, it becomes possible to reduce the total electric power consumed by the power supply circuit, the driving circuits, the liquid crystal panel, and the like, of the liquid crystal display device. Furthermore, the power supply circuit and the driving circuits can be constructed in simpler fashions. Although there are as large as 203 scanning lines, the driver IC is allowed to have a breakdown voltage as low as 12 V or lower. This allows a reduction in cost. Still furthermore, as shown in FIG. 3, it becomes possible to combine the power supply circuit, the control circuit, the signal electrode driving circuit, the scanning electrode driving circuit, and the like on a single chip in an integral fashion, which results in a reduction in the total size.

In the first to third embodiments described above, when the division (total number of scanning electrodes)/(number of scanning electrodes selected at the same time) has a remainder, the remaining scanning electrodes are driven by selecting signal voltages applied to those signal electrodes, assuming that there are as many scanning electrodes as in the normal state.

Fourth Embodiment

Figure 19:
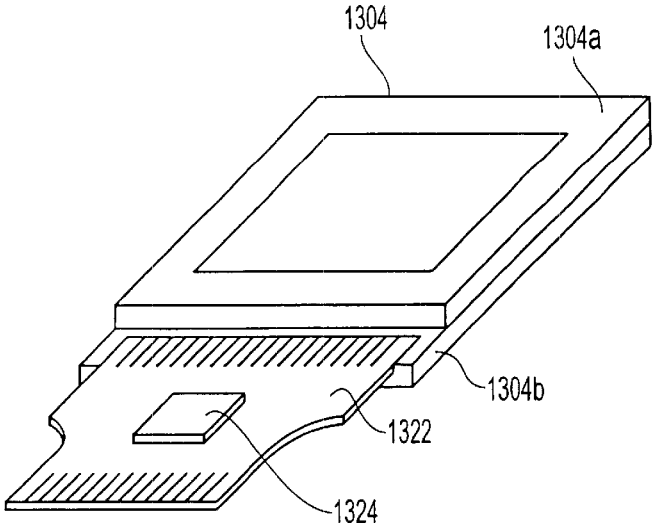
FIG. 19 is a perspective view of a liquid crystal display device, on which a driving integrated circuit is mounted, according to a fourth embodiment of the present invention.

In the liquid crystal display device according to any of first to third embodiments, at least the scanning electrode driving circuit and the signal electrode driving circuit may be integrated together on a single-chip driver integrated circuit or in addition to the scanning electrode driving circuit and the signal electrode driving circuit, other circuits such as a control circuit, a power supply circuit, and the like may be further integrated, and the single-chip driver integrated circuit (driver IC 31 shown in FIG. 3) may be mounted as shown in FIG. 19.

In FIG. 19, reference numeral 1304 denotes a liquid crystal panel on which scanning electrodes and signal electrodes are formed in a matrix according to the first or second embodiment. 1304*a* and 1304*b* denote a pair of substrates made of glass, for example, wherein the scanning electrodes and signal electrodes are formed on the inner surfaces thereof. The electrodes formed on the substrate 1304*a* are connected to the interconnection electrodes formed on the substrate 1304*b* via up-to-down conducting members (not shown). Reference numeral 1322 denotes a flexible tape on which the driver integrated circuit 1324, described above, is mounted. The driver integrated circuit 1322 has scanning voltage output terminals and signal voltage output terminals which are electrically connected to input terminals of the scanning electrodes and the signal electrodes, respectively, via an anisotropic conductive film, wherein the input terminals are located on the end part of the substrate 1304*b*. The tape 1322 is also bonded to the substrate 1304*b*. Alternatively, the driver integrated circuit 322 may be mounted directly on the substrate 1304*b* by means of the COG mounting technique, without using a flexible tape.

By employing the driver integrated circuit in the single-chip form, it becomes possible to mount the driver integrated circuit into a simpler structure by a simpler process. Furthermore, a reduction in the number of components is achieved and a device with a smaller size can be realized.

Fifth Embodiment

A small-sized low-cost electronic apparatus, such as a portable telephone, small-sized information apparatus, and the like, capable of displaying a high-quality image with low power consumption can be realized by employing a liquid crystal display device driven by any method disclosed in the first, second, or third embodiment.

Figure 20A:
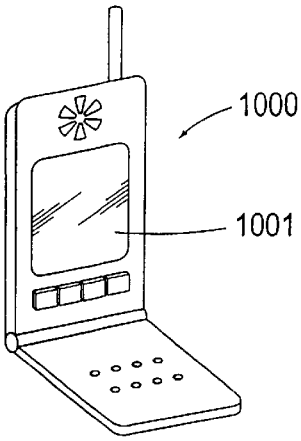
FIG. 20 is a schematic diagram illustrating electronic apparatuses according to a fifth embodiment of the present invention.
Figure 20B:
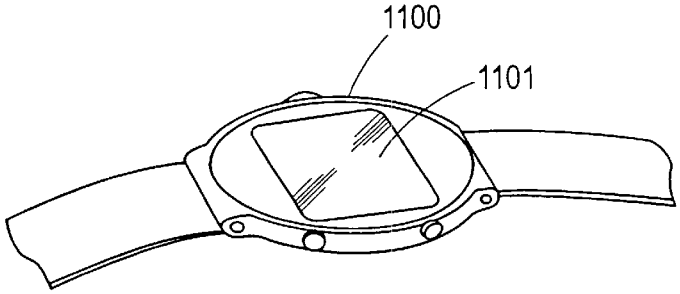

FIG. 20 illustrates external appearances of some electronic apparatuses using a liquid crystal display device according to the present invention. FIG. 20A is a perspective view of a portable telephone. In FIG. 20A, reference numeral 1000 denotes the main body of the portable telephone. 1001 denotes a liquid crystal display part using a reflective type liquid crystal display device according to the present invention. FIG. 20B illustrates a wristwatch type electronic apparatus. Reference numeral 1100 denotes the main body of the watch. 1101 denotes a liquid crystal display part using a reflective type liquid crystal display device according to the present invention. The pixel density of the liquid crystal display device employed herein is higher than that of the conventional clock display part, and thus the liquid crystal display device may display even a TV picture. That is, a wristwatch type TV can be realized.

Figure 20C:
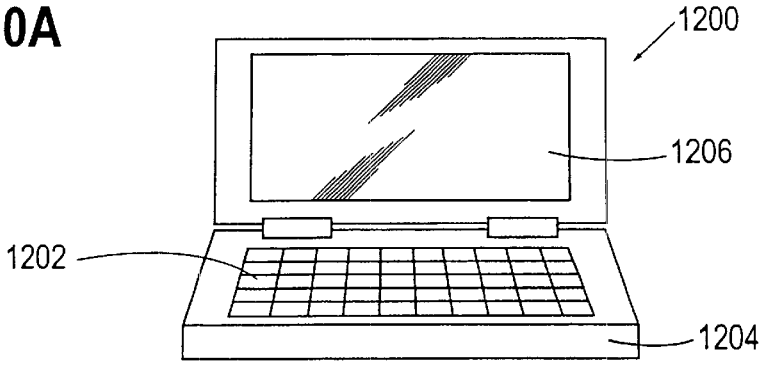

FIG. 20C illustrates a portable type information processing device such as a word processor, personal computer, and the like. Reference numeral 1200 denotes an information processing device, 1202 denotes an input device such as a keyboard, 1206 denotes a display part using a liquid crystal display device according to the present invention, and 1204 denotes the main body of the information processing device. These electronic apparatuses are driven by battery. Therefore, if a driving circuit in the form of an integrated circuit which is capable of being driven by a low voltage is employed, it becomes possible to increase the battery life. Furthermore, the employment of the driver circuit in the form of a single-chip integrated circuit results in a great reduction in the number of components, and thus, further reductions in weight and size can be achieved.

In the first to fifth embodiments described above, four or seven lines are selected at a time. Instead, an arbitrary number of lines may be selected at a time. That is, the number of lines selected at a time may be any of 2, 3, 5, 6, 8, . . . . In any case, driving may be performed in a similar manner according to the present invention by setting the amplitude of the scanning voltage waveform to a value equal to the amplitude of the signal voltage waveform.

Furthermore, although in the above-described embodiments, the total number of scanning electrodes to be driven is 64, 120, or 203, and a liquid crystal of type 2 is employed, the total number of scanning electrodes may be equal to or smaller or larger than 64. In any case, reductions in power consumption and cost can be achieved according to the present invention. A low-voltage liquid crystal such as that of type 1 may also be employed to achieve a further reduction in power consumption.

Furthermore, although in the above-described embodiments, an image is displayed in a two-level display (in an on/off display), a gray-scale image may also be displayed by applying pulse width modulation (PWM) voltage waveform to signal electrodes during selection periods or by employing frame rate control (FRC).

Furthermore, although a reflective type STN liquid crystal is employed as the liquid crystal of the liquid crystal panel, the liquid crystal is not limited to that. For example, a bistable type liquid crystal such as that of the ferroelectric type or of the antiferroelectric type, a high-polymer dispersion liquid crystal, a TN liquid crystal, a nematic liquid crystal, or other various types of liquid crystals may also be employed. Furthermore, instead of a reflective type liquid crystal panel, a transmissive liquid crystal panel may also be employed in the present invention.

Still furthermore, although in the above-described embodiments, the liquid crystal panel is of the simple matrix type, the driving method according to the present invention may also be applied to an active matrix type liquid crystal panel including pixel electrodes arranged in a matrix on one panel substrate, wherein each pixel is connected to a two-terminal non-linear element serving as a switching element, and wherein the respective two-terminal switching elements and a liquid crystal layer are electrically connected in series between scanning electrodes and signal electrodes.

In the driving method based on multi-line selection, the signal polarity of the selection voltage applied to the scanning electrodes is determined in accordance with a normal orthogonal matrix. Herein, the signal polarity refers to a polarity with respect to the non-selection voltage Vc of the scanning voltages. If Vc=0 V, a positive selection voltage and a negative selection voltage are determined in accordance with a normal orthogonal matrix. Alternatively, all scanning voltage levels may be positive or all levels may be negative with respect to GND voltage. In this case, Vc≠0 V, and thus, scanning voltages are selected from positive and negative selection voltages with respect to Vc in accordance with a normal orthogonal matrix.

As described above, by driving the liquid crystal display device using the driving method and/or using the driving circuit according to any of first to fifth embodiments, a reduction in the driving voltage and also a reduction in the number of levels associated with the driving voltage can be achieved. As a result, it becomes possible to reduce the total electric power consumed by the power supply circuit, the driving circuits, the liquid crystal panel, and the like, of the liquid crystal display device. Furthermore, the power supply circuit and the driving circuits can be constructed in simpler fashions. Contrast can be improved by employing a liquid crystal with optimized characteristics. Still furthermore, the driver integrated circuit is allowed to have a low breakdown voltage, which allows a reduction in cost. Still furthermore, it becomes possible to combine the power supply circuit, the control circuit, the signal electrode driving circuit, the scanning electrode driving circuit, and the like on a single chip in an integral fashion which results in a reduction in the total size. Still furthermore, it is possible to realize a small-sized low-cost electronic apparatus including a liquid crystal display device using the driving method and/or the driving circuit according to the present invention capable of displaying a high-quality image with low power consumption.

Sixth Embodiment

Figure 21:
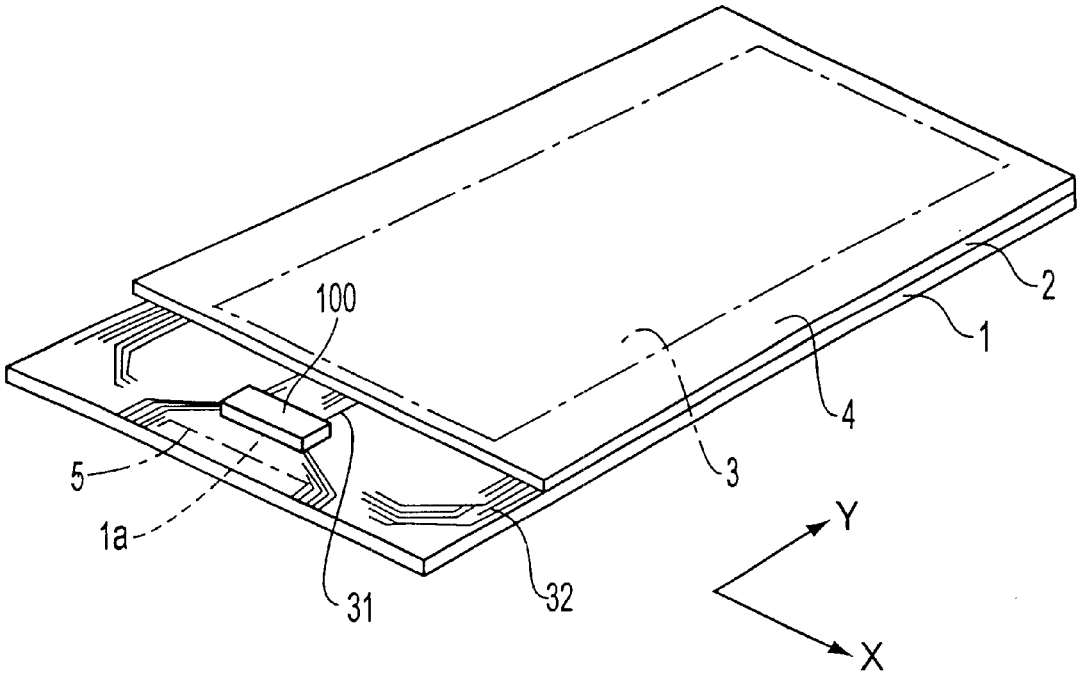
FIG. 21 is a perspective view illustrating the external appearance of a liquid crystal device according to a sixth embodiment of the present invention.
Figure 22:
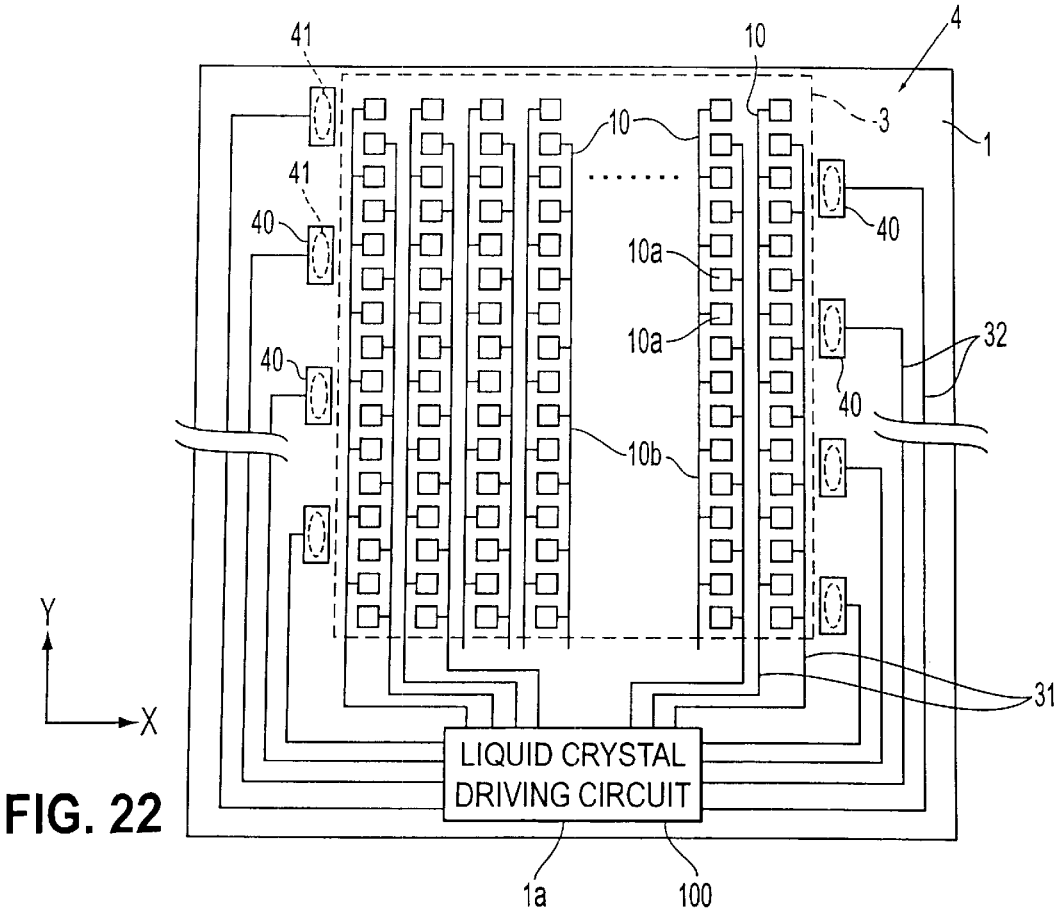
FIG. 22 is a plan view of a first substrate according to the sixth embodiment.
Figure 23:
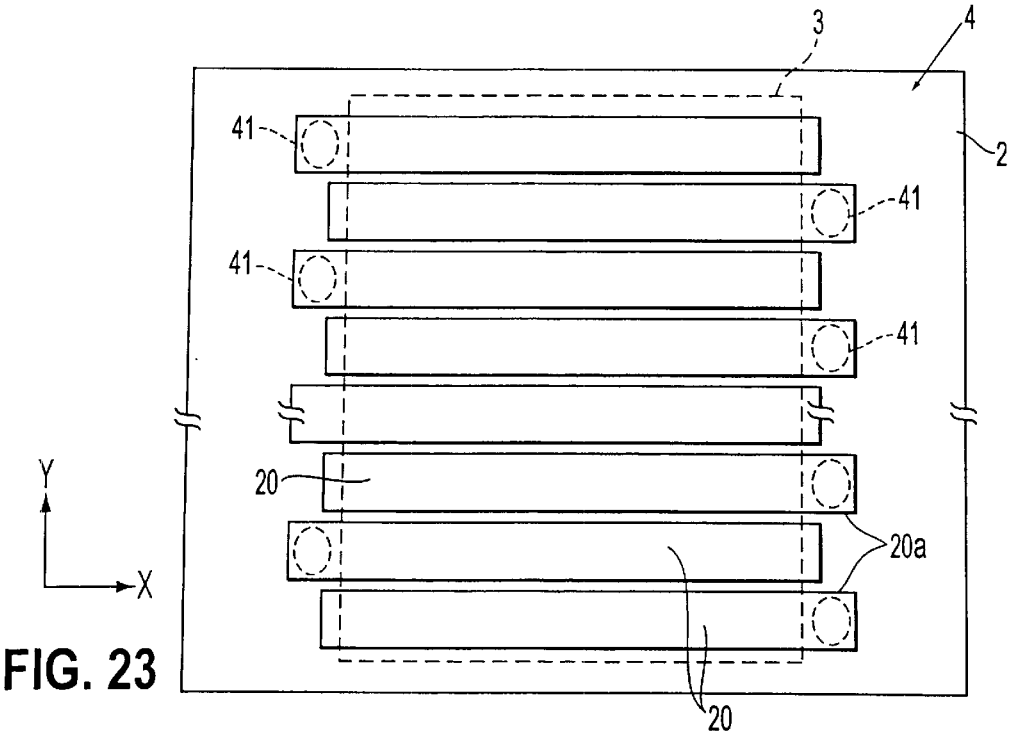
FIG. 23 is a plan view of a second substrate according to the sixth embodiment.

Referring now to FIGS. 21 to 24, a sixth embodiment of the present invention is described below. In this sixth embodiment, a panel structure using the driving method according to any of first to third embodiments is employed to realize a liquid crystal display device. FIG. 21 illustrates the external appearance of the liquid crystal display device. FIG. 22 is a plan view illustrating the layout of signal electrodes and other elements disposed on a first substrate of the liquid crystal device. FIG. 23 is a plan view illustrating the layout of scanning electrodes and other elements disposed on a second substrate of the liquid crystal device. FIG. 24 is an enlarged view illustrating some specific examples of electrode structures.

In the liquid crystal display device according to the sixth embodiment, as shown in FIG. 21, a first substrate 1 (corresponding to 1304*a* in FIG. 19) and a second substrate 2 (corresponding to 1304*b* in FIG. 19) are disposed such that they oppose each other, and an STN liquid crystal is disposed in a sealed fashion between the first and second substrates. In the plan view, an image display regions 3 where an image is actually displayed is defined in a central area of the substrates between which the liquid crystal is disposed. A frame region 4 is defined in an outer area surrounding the image display region 3. A driving circuit 100 in the form of a single chip is mounted on the first substrate 1, in a mounting area 1*a* of the frame region 4. This driver integrated circuit 100 corresponds to the driver integrated circuit 31 shown in FIG. 3 or 1324 shown in FIG. 19.

As shown in FIGS. 21 and 22, a plurality of signal electrodes 10 are formed in the image display region 3 on the first substrate 1 such that they form a multiple-fold matrix structure together with scanning electrodes 20. Each signal electrode 10 includes a plurality of pixel electrodes 10*a* disposed at the respective pixels and a signal interconnecting part 10*b* connected to the plurality of pixel electrodes 10*a*. Each electrode 10 extends in a Y direction. On the other hand, as shown in FIGS. 21 and 23, a plurality of scanning electrodes 20 are formed in the image display region 3 on the second substrate 2 in such a manner that each line of scanning electrode extends over a plurality of pixel electrodes 10*a* connected to a plurality of signal electrodes 10. That is, each scanning electrode extends in an X direction. The scanning electrodes 20 and the signal electrodes 10 correspond to the scanning electrodes 54 and the signal electrodes 53, respectively, shown in FIG. 5.

As shown in FIGS. 21 and 22, the driving circuit 100 in the single chip form is mounted on the first substrate 1, in the mounting area 1*a* located at the side (the lower side of FIG. 22) of one end of each signal electrode 10. The driving circuit 100 supplies a signal voltage waveform and a scanning voltage waveform at predetermined times to the signal electrodes 10 and the scanning electrodes 20, respectively, thereby driving these electrodes. More specifically, display data in a predetermined format is supplied from an external circuit to the driving circuit 100 via external input terminals 5 shown in FIG. 21. In accordance with the received display data, the driving circuit 100 performs a driving operation in the manner disclosed in any of the first to fifth embodiments, thereby displaying an image in the image display region 3.

In the frame region 4, as shown in FIG. 22, a plurality of first interconnection lines 31 extend so as to connect the driving circuit 100 to one end of each signal electrode 10 located near the driving circuit 100. Furthermore, in the frame region 4, a plurality of second interconnection lines 32 extend so as to connect the driving circuit 100 to up-to-down conducting terminals 40 formed on the first substrate 1. Still furthermore, in the frame region 4, as shown in FIGS. 22 and 23, a plurality of up-to-down conducting members 41 are disposed between the first substrate 1 and the second substrate 2 such that the up-to-down conducting terminals 40 formed on the first substrate are electrically connected to the ends 20*a*, located in the frame region 4 of the respective scanning electrodes 20 via the up-to-down conducting members 41.

In the present embodiment, as described above, the driving circuit 100 is connected in the frame region 4 to the ends located near the driving circuit 100 of the respective signal electrodes via the first interconnection lines 31. This makes it unnecessary to extend the first interconnection lines 31 along long paths around the image display region 3 (refer to FIG. 22). That is, the length of each first interconnection line 31 becomes very short.

Figure 24A:
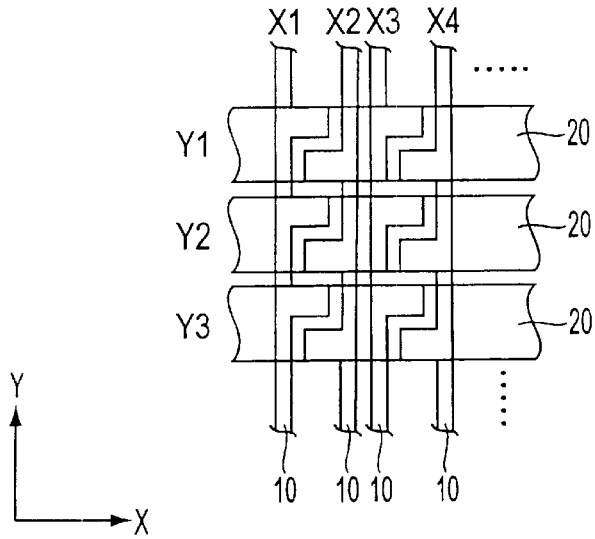
FIG. 24 is an enlarged plan view illustrating specific examples of signal electrodes and scanning electrodes according to the sixth embodiment.
Figure 24B:
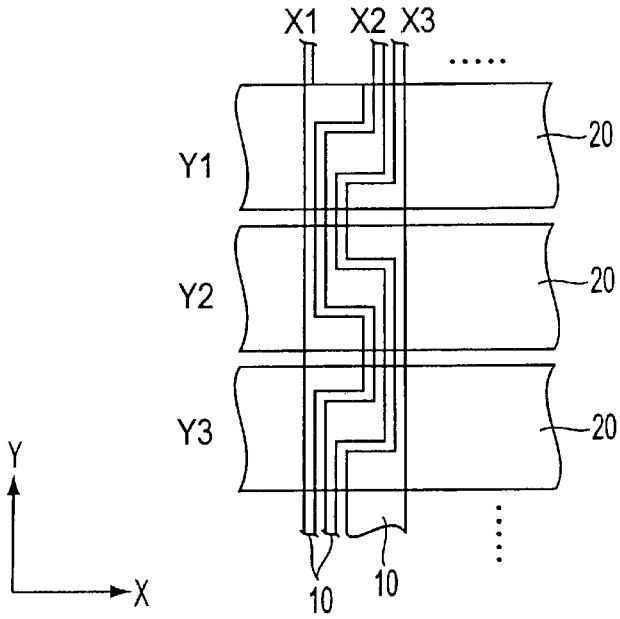

When the signal electrodes 10 and the scanning electrodes 20 are arranged in a two-fold matrix fashion as shown in FIG. 24A, the widths of the respective scanning electrodes 20 for supplying scanning signals Y1, Y2, . . . are set to be equal to the total size of two pixels arranged in the Y direction so that each scanning electrode 20 opposes arrays of pixels formed by two adjacent signal electrodes 10 for supplying image signals X1, X2, . . . . The total number of scanning electrodes 20 becomes one-half the number of scanning electrodes which are required in a non-multiple matrix structure (that is, a single-fold matrix structure in which one pixel is defined at each intersection between the scanning electrodes and the signal electrodes). In the case where the signal electrodes 10 and the scanning electrodes 20 are arranged in a three-fold matrix form as shown in FIG. 24B, the widths of the respective scanning electrodes 20 are set to be equal to the total size of three pixels arranged in the Y direction so that each scanning electrode 20 opposes arrays of pixels formed by three adjacent signal electrodes 10. In this case, the total number of scanning electrodes 20 becomes about ⅓ times the number of scanning electrodes which are required in the non-multiple matrix structure.

In general, when the signal electrodes 10 are arranged in an n-fold matrix structure (where n is an integer equal to or greater than 2), the width of each scanning electrode 20 is set to be equal to the total size of n pixels such that each scanning electrode 20 opposes arrays of pixels which are formed by n adjacent signal electrodes 10 and which are arranged in the Y direction. In this case, the total number of scanning electrodes 20 becomes 1/n times the number of scanning electrodes 20 which are required in the non-multiple matrix structure. In the specific example shown in FIG. 24, the pixel electrodes 10*a* and the signal interconnecting parts 10*b* are made of a transparent conductive film such as an ITO (Indium Tin Oxide) film or an opaque conductive film such as an Al (aluminum) film, in an integral fashion. Alternatively, the pixel electrodes 10*a* and the signal interconnecting parts 10*b* may be made of different materials. For example, the pixel electrode 10*a* may be made of a transparent conductive film such as an ITO film, and the signal interconnecting parts 10*b* may be made of an opaque conductive film, such as an Al film.

Thus, in the present embodiment, the multiple-fold matrix structure is designed taking into account the width of each scanning electrode 20 and the total number of scanning electrodes 20, such that, as shown in FIG. 22, the driving circuit 100 is connected via the second interconnection lines 32 to the up-to-down conducting terminals 40 in contact with the up-to-down conducting members 41 which are in turn connected to the ends 20*a* of the scanning electrodes 20, thereby reducing the total number of second interconnection lines 32 to a value about 1/n times the total number of second interconnection lines which are required in the non-multiple matrix structure. For example, in the case where the image display region 3 includes 100 pixels in the Y direction and 100 pixels in the X direction, only 50 second interconnection lines 32 are needed.

Thus, it becomes possible to reduce the total area occupied in the frame region 4 by the second interconnection lines 32 to a value about 1/n times the area which is required in the non-multiple matrix structure. That is, although the driving circuit 100 is of the single-chip type, it is possible to effectively minimize the increase in the area occupied in the frame region 4 by the second interconnection lines 32. On the other hand, because each scanning electrode 20 has a width n times the size of one pixel, as shown in FIG. 24, the width of each scanning electrode 20 is much greater than that of the signal electrodes 10, and thus the employment of the driving circuit 100 in the single-chip form does not result in requirement of high-precision microfabrication technology. Thus, as can be seen from the above discussion, it becomes possible to reduce the area of the frame region 4 relative to the image display region 3 by employing the first interconnection lines 31 extending along rather short paths and the reduced number of second interconnection lines 32, as shown in FIG. 22. Furthermore, it is possible to reduce the total number of up-to-down conducting terminals 40 which occupy a particular area in the frame region 4 and which are required to be formed taking into account the alignment error which can occur when the first substrate 1 and the second substrate 2 are bonded to each other, down to a value about 1/n times the number of terminals in accordance with the degree of multiplicity n, which makes it possible to miniaturize the frame region 4.

Furthermore, it also becomes possible to minimize the resistance associated with the interconnections from the driving circuit 100 to the scanning electrodes 20 and the signal electrodes 10 by employing the first interconnection lines 31 extending along rather short paths and the reduced number of second interconnection lines 32. Thus, degradation of the image signal or degradation of the scanning signal due to the interconnection resistance can be prevented. Furthermore, it also becomes possible to display a high-quality image even when the driving circuit 100 has a rather low driving capability and/or a low breakdown voltage. The electric power consumed in the driving operation can also be reduced.

Furthermore, the selection-time period during one frame, during which the image signal is supplied to the signal electrodes 10 from the driving circuit 100 can be increased by a factor of n, wherein n is the degree of multiplicity. Thus, the driving voltage may also be reduced by reducing the duty ratio. In this case, contrast and luminance of the image displayed in the image display region 3 are also enhanced. Another important advantage is that the signal electrodes 10 in the multiple-fold matrix structure, the first interconnection lines 31, the second interconnection lines 32, and the driving circuit 100 in the single-ship form may all be produced using the conventional microfabrication technology.

In the present embodiment, as shown in FIG. 23, the scanning electrodes 20 extend in an interdigital fashion from both sides of the image display region 3 toward the inner area of the image display region 3. This allows a reduction in the number of up-to-down conducting members 41 disposed at one side of the image display region 3 to a value one-half the total number of scanning electrodes 20. Furthermore, as shown in FIG. 21, on the first substrate 1, there may be disposed a half of second interconnection lines 32 in an area of the frame region 4 at one side of the image display region 3 and another half at the opposite side of the image display region 3. This allows the second interconnection lines 32 to be equally distributed on both sides within the frame region 4. For example, in the case where the image display region 3 includes 100 pixels in the Y direction and 100 pixels in the X direction, only 25 second interconnection lines 32 are needed on each side. That is, it is possible to equally reduce the areas of both sides of the frame region in the X direction.

Furthermore, in the present embodiment, the image display region 3 is formed in a rectangular shape longer in the Y direction than in the X direction and the signal electrodes 10 and the scanning electrodes 20 are disposed such that a greater number of pixels are arranged in the Y direction than in the X direction. As can be seen from FIG. 22, the total number and the length of first interconnection lines 31 may be fixed regardless of the length of the image display region 3 in the Y direction. As for the total number of second interconnection lines 32, is required to only increase one second interconnection line 32 each time the number of pixels in the Y direction is increased by n (refer to FIG. 24). In this case, it is required to increase the length of the second interconnection line 32 only by an amount corresponding to the increase in the length of the image display region 3 in the Y direction (refer to FIG. 22). Thus, the present invention provides greater advantages in particular when the length of the image display region 3 in the Y direction becomes longer. For example, in the case where the image display region 3 includes 120 pixels in the Y direction and 60 pixels in the X direction, only 30 second interconnections 32 are needed in total (15 second interconnections 32 on each side). The liquid crystal display device longer in the Y direction is particularly advantageous when used in applications where it is desirable that the screen be longer in the vertical direction depending on the external shape of a device, as is the case with portable telephones. To obtain a screen which is longer in the vertical direction, it is generally required to perform additional signal processing on image data, such as aspect ratio conversion. However, in the present embodiment, it is possible to drive a screen which is longer in the vertical direction and shorter in the scanning direction (X direction) in accordance with the conventional scanning method with a rather simple construction. This provides a great advantage in practical applications.

In the present embodiment, as shown in FIG. 21, the driving circuit is mounted on the first substrate using, for example, the COG (Chip On Glass) mounting technique. Alternatively, a molded driving circuit 100 in the molded form with lead terminals or packaged in a flat package may be mounted on the first substrate 1.

Seventh Embodiment

Figure 25:
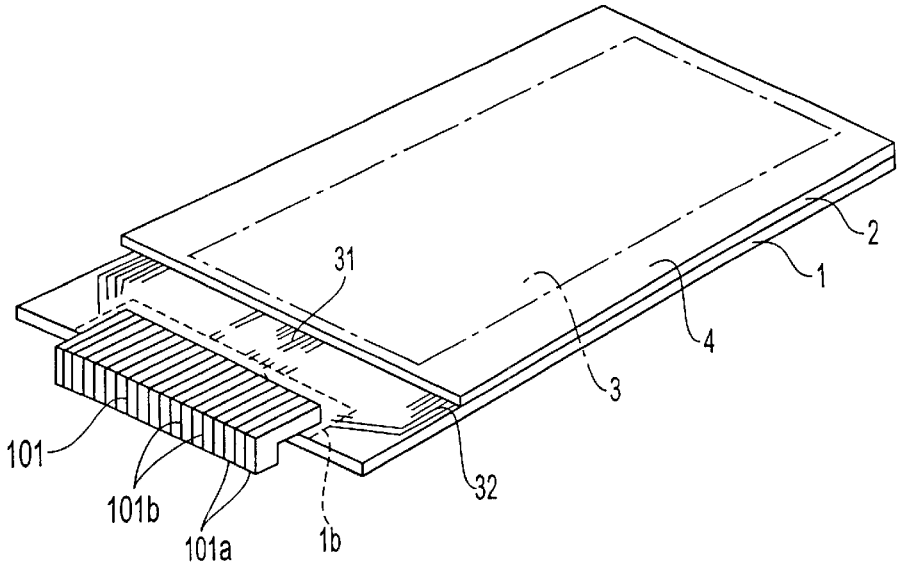
FIG. 25 is a perspective view illustrating the external appearance of a liquid crystal device according to a seventh embodiment of the present invention.

FIG. 25 illustrates a seventh embodiment of the present invention. The seventh embodiment is similar the sixth embodiment described above except that the driving circuit 100 is mounted in a different manner. The external appearance of a liquid crystal display device is shown in FIG. 25.

In the liquid crystal display device according to the seventh embodiment, as shown in FIG. 25, input terminals 1*b* connected to the first interconnection lines 31 and the second interconnection lines 32 are formed at particular locations on the first substrate 1. A driving circuit in the form of a single chip (not shown) is connected to the input terminals 1*b* via a dedicated connector 101. The dedicated connector 101 is formed in a multilayer structure in which a large number of insulating layers 101*a* and a large number of conductive layers 101*b* are alternately disposed at intervals equal to the terminal pitch of the input terminals 1*b*, such that each conductive layer 101*b* is sandwiched between insulating layers 101*a*. The dedicated connector 101 has an L-like shape in cross section when seen from the laminating direction so that electric connections to an interconnection board disposed under and on the back of the first substrate 1 are easily made via the dedicated connector 101. The dedicated connector 101 may also be formed so as to have a different shape in cross section. For example, both end portions of the dedicated connector 101 may be bent in the same direction.

Eighth Embodiment

Figure 26:
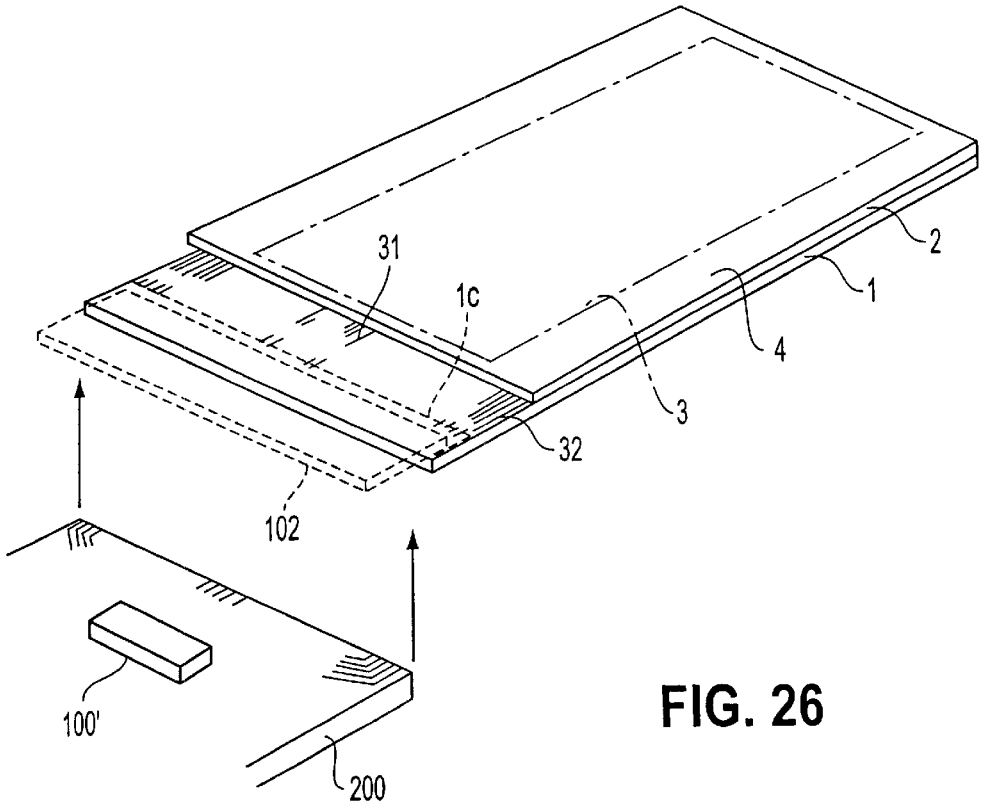
FIG. 26 is a perspective view illustrating the external appearance of a liquid crystal device according to an eighth embodiment of the present invention.

FIG. 26 illustrates an eighth embodiment of the present invention. The eighth embodiment is similar the seventh embodiment described above except that the driving circuit 100 is mounted in a different manner. The external appearance of a liquid crystal display device is shown in FIG. 26.

In the liquid crystal display device according to this eighth embodiment, as shown in FIG. 26, input terminals 1*c* connected to the first interconnection lines 31 and the second interconnection lines 32 are formed at particular locations on the first substrate 1. A single-chip driving circuit 100' is mounted on a circuit board 200 such as a printed board connected to the input terminals 1*c* via an ACF (Anisotropic Conductive Film) 102.

Alternatively, the single-chip driving circuit may be mounted on a TAB (Tape Automated Bonding) substrate or an FPC (Flexible Printed Circuit) substrate, and may be connected in the form of a TCP (Tape Carrier Package) to the input terminals 1*c* on the first substrate 1.

In the embodiments described above, a polarization film, a retardation film, a polarizer, and the like, are disposed in a particular direction on a substrate depending on the operating mode. The possible operating modes include a TN (Twisted Nematic) mode, a VA (vertically Aligned) mode, a PDLC (Polymer Dispersed Liquid Crystal) mode, a normally white mode, and a normally black mode. A color filter or a black matrix may be disposed on the substrate as required, depending on whether the device is operated in a monochrome mode or color mode.

In the embodiments described above, the signal electrodes may be replaced with scanning electrodes formed in a multiple-fold matrix and the scanning electrodes are replaced with signal electrodes formed in stripes. In this case, a single-chip driving circuit is mounted on a substrate on which the scanning electrodes are formed. The driving methods described above in the first to third embodiments may be applied to the sixth to eighth embodiments so as to reduce the number of voltage levels, thereby allowing the driver integrated circuit for performing multiple-fold matrix driving to have a smaller breakdown voltage. This also makes it possible to form the driver integrated circuit in a simpler fashion. Electro-optical devices constructed in the above-described manner have the advantage that a display panel required to be longer in the vertical direction, as is the case with a portable telephone, can be realized without resulting a significant increase in the number of scanning lines, and thus, it is easy to form the driver integrated circuit into the form of a single chip In the signal electrodes 10 in the sixth to eighth embodiments, a two-terminal non-linear element such as a thin-film diode may be connected in series between a pixel electrode 10*a* and a signal interconnecting part 10*b* for each pixel, thereby realizing an active matrix liquid crystal display device. This makes it possible to drive the respective pixel electrodes 10*a* by switching the two-terminal non-linear elements connected to the respective pixel electrodes 10*a* in an active matrix according the driving method disclosed above in the first to third embodiments, thereby achieving, in particular, enhancement of contrast ratio.

The techniques disclosed in the above-described embodiments may be applied to various types of electro-optical devices, such as an EL (Electro-luminescence) display device, a plasma display device, and the like, which are driven in a matrix using scanning electrodes and signal electrodes.

That is, the electro-optical device according to the present invention is not limited to those described above with reference to the embodiments. Various modifications may be made without departing from the sprit of the invention described above and without departing from the scope as defined in the claims. It should be understood that such a modified electro-optical device will also be included in the present invention.

What is claimed is:

1. An electro-optical device, comprising:

a plurality of scanning electrodes organized into groups, each group having a plural number of scanning electrodes, which are simultaneously selected for scanning voltages to be applied;

a plurality of signal electrodes, the plurality of scanning electrodes and the plurality of signal electrodes crossing each other;

a signal electrode driving circuit that applies signal voltages to the signal electrodes; and a scanning electrode driving circuit that applies scanning voltages to the scanning electrodes, the scanning voltages including selection voltages to select the plurality of scanning electrodes and selection of scanning electrodes is performed group by group, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages, the scanning electrode driving circuit and the signal electrode driving circuit are integrated on a single-chip driving circuit IC.

2. An electro-optical device, comprising:

a plurality of scanning electrodes organized into groups in which each group having a plural number of scanning electrodes which are simultaneously selected for scanning voltages to be applied;

a plurality of signal electrodes, the plurality of scanning electrodes and the plurality of signal electrodes crossing each other;

a signal electrode driving circuit that applies signal voltages to the signal electrodes;

at least two scanning electrode driving circuits that apply scanning voltages that include selection voltages to the scanning electrodes, selection of scanning electrodes being performed group by group, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages; and a power supply circuit that generates the selection voltages and the signal voltages being integrated on a single-chip driving circuit IC.

3. An electro-optical device, comprising:

a plurality of scanning electrodes organized into groups, each group having of a plural number of scanning electrodes which are simultaneously selected for scanning voltages to be applied, and selection of scanning electrodes being performed group by group, the plural number of scanning electrodes which are simultaneously selected include a virtual scanning electrode such that simultaneously selecting a number of actual scanning electrodes is equal to the plural number of scanning electrodes minus a number of the virtual scanning electrodes;

a plurality of signal electrodes, the plurality of scanning electrodes and the plurality of signal electrodes crossing each other;

a signal electrode driving circuit that applies signal voltages to the signal electrodes; and a scanning electrode driving circuit that applies scanning voltages to the scanning electrodes, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages.

4. An electro-optical device, comprising:

a plurality of scanning electrodes organized into groups, each group having a plural number of scanning electrodes which are simultaneously selected for scanning voltages to be applied, and selection of scanning electrodes being performed group by group;

a plurality of signal electrodes, the scanning electrodes and the signal electrodes being arranged such that they cross each other in a multi-fold matrix;

a signal electrode driving circuit that applies signal voltages to the signal electrodes;

a scanning electrode driving circuit that applies scanning voltages to the scanning electrodes, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages;

a first substrate on which the scanning electrodes are formed;

a second substrate on which the signal electrodes are formed being disposed such that the first substrate and the second substrate oppose each other; and a single-chip driving circuit IC on which the scanning electrode driving circuit that applies selection voltages to the scanning electrodes and the signal electrode driving circuit that applies signal voltages to the signal electrodes are integrated being mounted on one of the first substrate and the second substrate, and the one of the first substrate and the second substrate being connected to another of the first substrate and the second substrate via an up-to-down conducting member.

5. An electro-optical device, comprising:

a plurality of scanning electrodes organized into groups, each group having a plural number of scanning electrodes which are simultaneously selected for scanning voltages to be applied, and selection of scanning electrodes being performed group by group;

a plurality of signal electrodes, the plurality of scanning electrodes and the plurality of signal electrodes crossing each other;

a signal electrode driving circuit that applies signal voltages to the signal electrodes;

a scanning electrode driving circuit that applies scanning voltages to the scanning electrodes, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages;

the scanning voltages applied to the scanning electrodes including the non-selection voltage, a first selection voltage which is positive with respect to the non-selection voltage, and a second selection voltage which is negative with respect to the non-selection voltage, and the signal voltages applied to the signal electrodes including a maximum signal voltage and a minimum signal voltage set equal to the first selection voltage and the second selection voltage.

6. A liquid crystal display device, comprising:

a plurality of scanning electrodes organized into groups, each group having a plural number of scanning electrodes which are simultaneously selected for scanning voltages to be applied, and selection of scanning electrodes being performed group by group;

a plurality of signal electrodes, the plurality of scanning electrodes and the plurality of signal electrodes crossing each other;

a signal electrode driving circuit that applies signal voltages to the signal electrodes;

a scanning electrode driving circuit that applies scanning voltages to the scanning electrodes, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages; and a liquid crystal in which a root-means-square value of an on-voltage applied to the liquid crystal divided by a root-means-square value of an off-voltage applied to the liquid crystal is greater than or equal to a saturation voltage of the liquid crystal divided by a threshold voltage of the liquid crystal.

7. An electro-optical device, comprising:

a plurality of scanning electrodes organized into groups, each group having a plural number of scanning electrodes which are simultaneously selected for scanning voltages to be applied, and selection of scanning electrodes being performed group by group;

a plurality of signal electrodes, the plurality of scanning electrodes and the plurality of signal electrodes crossing each other;

a signal electrode driving circuit that applies signal voltages to the signal electrodes;

at least two scanning electrode driving circuits that apply scanning voltages to the scanning electrodes, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages; and a single-chip circuit IC, at least two scanning electrode driving circuits that apply selection voltages to the scanning electrodes, the signal electrode driving circuits that apply signal voltages to the signal electrodes, and the power supply circuit that applies the selection voltages and the signal voltages being integrated on the single-chip driving circuit IC.

8. An electro-optical device, comprising:

a plurality of electro-optical elements arranged in a matrix, each electro-optical element being disposed at an intersection of one of a plurality of scanning electrodes and one of a plurality of signal electrodes;

a first selection circuit that selects one amplitude, according to an orthogonal function that defines amplitudes of a plurality of scanning voltages, among first predetermined amplitudes as each of the amplitudes of a predetermined number of scanning voltages of the plurality of scanning voltages;

a second selection circuit that selects one amplitude, according to display data that define an image that each electro-optical element should display, among second predetermined amplitudes as an amplitude of a signal voltage, wherein a predetermined number of amplitudes of the first predetermined amplitudes and a predetermined number of amplitudes of the second predetermined amplitudes are equal;

a first application circuit that simultaneously applies the predetermined number of scanning voltages each having the amplitude selected by the first selection circuit, to a predetermined number of scanning electrodes of the plurality of scanning electrodes; and a second application circuit that applies the signal voltage having the amplitude selected by the second selection circuit to one of the plurality of signal electrodes.

9. An electronic apparatus, comprising:

a liquid crystal display; and a driver circuit to drive the liquid crystal display, the driver circuit including:

a plurality of scanning electrodes organized into groups, each group having a plural number of scanning electrodes, which are simultaneously selected for scanning voltages to be applied;

a plurality of signal electrodes, the plurality of scanning electrodes and the plurality of signal electrodes crossing each other;

a signal electrode driving circuit that applies signal voltages to the signal electrodes; and a scanning electrode driving circuit that applies scanning voltages to the scanning electrodes, the scanning voltages include selection voltages to select the plurality of scanning electrodes and selection of scanning electrodes is performed group by group, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages, the scanning electrode driving circuit and the signal electrode driving circuit are integrated on a single-chip driving circuit IC.

10. An electronic apparatus, comprising:

a liquid crystal display; and a driver circuit to drive the liquid crystal display, the driver circuit including:

a plurality of scanning electrodes organized into groups in which each group having a plural number of scanning electrodes which are simultaneously selected for scanning voltages to be applied;

a plurality of signal electrodes, the plurality of scanning electrodes and the plurality of signal electrodes crossing each other;

a signal electrode driving circuit that applies signal voltages to the signal electrodes;

at least two scanning electrode driving circuits that apply scanning voltages that include selection voltages to the scanning electrodes, selection of scanning electrodes being performed group by group, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages; and a power supply circuit that generates the selection voltages and the signal voltages being integrated on a single-chip driving circuit IC.

11. An electronic apparatus, comprising:

a liquid crystal display; and a driver circuit to drive the liquid crystal display, the driver circuit including:

a plurality of scanning electrodes organized into groups, each group having of a plural number of scanning electrodes which are simultaneously selected for scanning voltages to be applied, and selection of scanning electrodes being performed group by group, the plural number of scanning electrodes which are simultaneously selected include a virtual scanning electrode such that simultaneously selecting a number of actual scanning electrodes is equal to the plural number minus a number of the virtual scanning electrodes;

a plurality of signal electrodes, the plurality of scanning electrodes and the plurality of signal electrodes crossing each other;

a signal electrode driving circuit that applies signal voltages to the signal electrodes; and a scanning electrode driving circuit that applies scanning voltages to the scanning electrodes, the scanning voltages having an amplitude of voltages applied to the scanning electrodes with respect to a non-selection voltage of the scanning voltages equal to an amplitude of the signal voltages applied to the signal electrodes with respect to the non-selection voltage of the scanning voltages.

12. An electronic apparatus, comprising:

a liquid crystal display; and a driver circuit to drive the liquid crystal display, the driver circuit including:

a plurality of scanning electrodes organized into groups, each group having a plural number of scanning electrodes which are simultaneously selected for scanning voltages to be applied, and selection of scanning electrodes being performed group by group;

a plurality of signal electrodes, the scanning electrodes and the signal electrodes being arranged such that they cross each other in a multi-fold matrix;

a signal electrode driving circuit that applies signal voltages to the signal electrodes;

a scanning electrode driving circuit that applies scanning voltages to the scanning electrodes, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages;

a first substrate on which the scanning electrodes are formed;

a second substrate on which the signal electrodes are formed being disposed such that the first substrate and the second substrate oppose each other; and a single-chip driving circuit IC on which a scanning electrode driving circuit that applies selection voltages to the scanning electrodes and a signal electrode driving circuit that applies signal voltages to the signal electrodes are integrated being mounted on one of the first substrate and the second substrate, and the one of the first substrate and the second substrate being connected to another of the first substrate and the second substrate via an up-to-down conducting member.

13. An electronic apparatus, comprising:

a liquid crystal display; and a driver circuit to drive the liquid crystal display, the driver circuit including:

a plurality of scanning electrodes organized into groups, each group having a plural number of scanning electrodes which are simultaneously selected for scanning voltages to be applied, and selection of scanning electrodes being performed group by group;

a plurality of signal electrodes, the plurality of scanning electrodes and the plurality of signal electrodes crossing each other;

a signal electrode driving circuit that applies signal voltages to the signal electrodes;

a scanning electrode driving circuit that applies scanning voltages to the scanning electrodes, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages;

the scanning voltages applied to the scanning electrodes including a non-selection voltage, a first selection voltage which is positive with respect to the non-selection voltage, and a second selection voltage which is negative with respect to the non-selection voltage, and the signal voltages applied to the signal electrodes including a maximum signal voltage and a minimum signal voltage set equal to the first selection voltage and the second selection voltage.

14. An electronic apparatus, comprising:

a liquid crystal display; and a driver circuit to drive the liquid crystal display, the driver circuit including:

a plurality of scanning electrodes organized into groups, each group having a plural number of scanning electrodes which are simultaneously selected for scanning voltages to be applied, and selection of scanning electrodes being performed group by group;

a plurality of signal electrodes, the plurality of scanning electrodes and the plurality of signal electrodes crossing each other;

a signal electrode driving circuit that applies signal voltages to the signal electrodes;

at least two scanning electrode driving circuits that apply scanning voltages to the scanning electrodes, the scanning voltages having an amplitude of voltages applied to the scanning electrodes with respect to a non-selection voltage of the scanning voltages is equal to an amplitude of the signal voltages applied to the signal electrodes with respect to the non-selection voltage of the scanning voltages; and a single-chip circuit IC, the at least two scanning electrode driving circuits that apply selection voltages to the scanning electrodes, the signal electrode driving circuit that applies signal voltages to the signal electrodes, and the power supply circuit that applies the selection voltages and the signal voltages being integrated on the single-chip driving circuit IC.

15. An electronic apparatus, comprising:

a liquid crystal display; and a driver circuit to drive the liquid crystal display, the driver circuit including:

a plurality of scanning electrodes and a plurality of signal electrodes, the plurality of scanning electrodes and the plurality of signal electrodes crossing each other, the plurality of scanning electrodes being organized into groups with each group consisting of a plural number of scanning electrodes which are simultaneously selected for scanning voltages to be applied, and selection of scanning electrodes being performed group by group;

a scanning electrode driving circuit that applies a scanning voltage to the scanning electrodes; and a signal electrode driving circuit that applies a signal voltage to the signal electrodes, an amplitude of voltages applied to the scanning electrodes with respect to a non-selection voltage of the scanning voltages is equal to an amplitude of voltages applied to the signal electrodes with respect to the non-selection voltage of the scanning voltages, and the scanning electrode driving circuit and the signal electrode driving circuit being integrated on a single-chip IC.

16. An electronic apparatus, comprising:

a liquid crystal display;

a driving circuit to drive the liquid crystal display;

a pair of first substrate and second substrate;

a plurality of signal electrodes formed in an image display region on the first substrate, each of the signal electrodes including a plurality of pixel electrode sections;

a plurality of scanning electrodes formed in the image display region on the second substrate, the plurality of scanning electrodes being ranged such that each electrode crosses a plural number of adjacent pixel electrode sections located in a direction in which the plurality of signal electrodes are disposed;

the driving circuit formed of a single chip that drives the plurality of signal electrodes and the plurality of scanning electrodes, the driving circuit being connected to a predetermined point located on one of the first substrate and the second substrate in a frame region surrounding the image display region;

a plurality of first interconnection lines formed on one of the first substrate and the second substrate in the frame region, the plurality of first interconnection lines connecting the driving circuit to one end of each of the plurality of signal electrodes;

a plurality of up-to-down conducting elements disposed between the first substrate and the second substrate in the frame region, the plurality of up-to-down conducting elements being connected respectively to the end portions of the plurality of scanning electrodes, the end portions being located in the frame region; and a plurality of second interconnection lines formed on one of the first substrate and the second substrate in the frame region, the plurality of second interconnection lines serving to connect the driving circuit to the plurality of up-to-down conducting elements.

17. An electronic apparatus, comprising:

a liquid crystal display; and a driver circuit to drive the liquid crystal display, the driver circuit including:

a plurality of electro-optical elements arranged in a matrix, each electro-optical element being disposed at an intersection of one of a plurality of scanning electrodes and one of a plurality of signal electrodes;

a first selection circuit that selects one amplitude, according to an orthogonal function that defines amplitudes of a plurality of scanning voltages, among first predetermined amplitudes as each of the amplitudes of a predetermined number of scanning voltages of the plurality of scanning voltages;

a second selection circuit that selects one amplitude, according to display data that define an image that each electro-optical element should display, among second predetermined amplitudes as an amplitude of a signal voltage, wherein a predetermined number of amplitudes of the first predetermined amplitudes and a predetermined number of amplitudes of the second predetermined amplitudes are equal;

a first application circuit that simultaneously applies the predetermined number of scanning voltages each having the amplitude selected by the first selection circuit, to a predetermined number of scanning electrodes of the plurality of scanning electrodes; and a second application circuit that applies the signal voltage having the amplitude selected by the second selection circuit to one of the plurality of signal electrodes.

18. An electronic apparatus, comprising:

a liquid crystal display; and a driver circuit to drive the liquid crystal display, the driver circuit including:

a plurality of electro-optical elements arranged in a matrix, each electro-optical element being disposed at an intersection of one of a plurality of scanning electrodes and one of a plurality of signal electrodes;

a first selection circuit that selects, according to an orthogonal function that defines amplitudes of a plurality of scanning voltages, one amplitude among first predetermined amplitudes as each of amplitudes of a predetermined number of scanning voltages of the plurality of scanning voltages;

a second selection circuit that selects, according to display data that defines an image that each electro-optical element should display, one amplitude among second predetermined amplitudes as an amplitude of a signal voltage, wherein a predetermined number of amplitudes of the first predetermined amplitudes and a predetermined number of amplitudes of the second predetermined amplitudes are equal;

a scanning electrode driving circuit that simultaneously applies the predetermined number of scanning voltages each having the amplitude selected by the first selection circuit, to a predetermined number of scanning electrodes of the plurality of scanning electrodes; and a signal electrode driving circuit that applies the signal voltage having the amplitude selected by the second selection circuit, to one of the plurality of signal electrodes.

* * * * *